US011591802B1

(12) United States Patent
Valore et al.

(10) Patent No.: US 11,591,802 B1
(45) Date of Patent: Feb. 28, 2023

(54) MODULAR ACCESS SYSTEM

(71) Applicant: Material Control, Inc., Croswell, MI (US)

(72) Inventors: Nick Valore, Lexington, MI (US); Paul Newton, Jeddo, MI (US); David A. Miller, Jr., Croswell, MI (US); Nicholas Robert Auquier, Carsonville, MI (US); Don Gibson, Fort Gratiot, MI (US); Phillip Alexander, Carsonville, MI (US); Melissa McGhee, Croswell, MI (US); Jordan Wurmlinger, Croswell, MI (US)

(73) Assignee: Material Control, Inc., Croswell, MI (US)

( * ) Notice: Subject to any disclaimer, the term of this patent is extended or adjusted under 35 U.S.C. 154(b) by 0 days.

(21) Appl. No.: 17/187,750

(22) Filed: Feb. 27, 2021

Related U.S. Application Data

(60) Provisional application No. 62/983,340, filed on Feb. 28, 2020, provisional application No. 62/983,321, filed on Feb. 28, 2020, provisional application No. 62/983,364, filed on Feb. 28, 2020.

(51) Int. Cl.
*E04F 11/035* (2006.01)
*E04F 11/02* (2006.01)

(52) U.S. Cl.
CPC ..... *E04F 11/035* (2013.01); *E04F 2011/0209* (2013.01)

(58) Field of Classification Search
CPC ..... E04F 11/025; E04F 11/112; E04F 11/02; E04F 11/08; E04F 11/035; E04F 11/1865; E04F 11/04; E04F 11/022; E04F 11/104; E04F 2011/0209; E04F 2011/1889; E04B 1/003; E04G 1/14; E04G 1/152; E04G 27/00; E06C 1/39
See application file for complete search history.

(56) References Cited

U.S. PATENT DOCUMENTS

| | | | |
|---|---|---|---|
| 1,460,680 | A | 7/1923 | Peters |
| 1,505,116 | A | 8/1924 | Wiebe |
| 1,576,635 | A | 3/1926 | Douglas |
| 1,593,783 | A | 7/1926 | Stresau |
| 1,815,048 | A | 7/1931 | Harrington |
| 1,944,159 | A | 1/1934 | Bailey |
| 1,960,863 | A | 5/1934 | Troy |

(Continued)

FOREIGN PATENT DOCUMENTS

| | | | |
|---|---|---|---|
| CA | 2421184 | A1 | 3/2002 |
| CA | 2491124 | A1 | 1/2004 |

(Continued)

OTHER PUBLICATIONS

Cotterman. Complete Guide to all Cotterman Products. May 2018.

(Continued)

*Primary Examiner* — Kyle J. Walraed-Sullivan
(74) *Attorney, Agent, or Firm* — Dykema Gossett PLLC

(57) ABSTRACT

A modular crossover system includes one or more platforms, one or more platform guardrails attached to the platform, a plurality of towers supporting the one or more platforms, a plurality of stile assemblies attached to the platforms, or a combination of towers and stile assemblies. An optional fixed ladder may be attached to one of the platforms.

13 Claims, 32 Drawing Sheets

(56) References Cited

U.S. PATENT DOCUMENTS 2,326,844 A 8/1943 Ely
2,335,046 A 11/1943 Droeger
2,585,150 A 2/1952 Mcgill
2,594,561 A 4/1952 Joseph
2,694,609 A 11/1954 Trafford
2,726,123 A 12/1955 Mathews
2,899,011 A 8/1959 Carl
2,989,141 A 6/1961 Howard
3,042,140 A 7/1962 Basile et al.
3,095,848 A 7/1963 Dick
3,104,889 A 9/1963 Branch, Jr.
3,250,401 A 5/1966 Davidson
3,307,653 A 3/1967 Gnehm
3,349,870 A 10/1967 Lieblein
3,381,775 A 5/1968 Livers
3,477,184 A 11/1969 Johnson
3,500,606 A 3/1970 Wharmby
3,693,754 A 9/1972 Butler
3,698,511 A * 10/1972 Dohan ..... E04G 1/14 182/119
3,869,109 A 3/1975 Russo
4,009,762 A 3/1977 Bjerkgard
4,030,255 A 6/1977 Hartman
4,042,064 A * 8/1977 Lobb ..... E01F 1/00 182/115
4,060,150 A 11/1977 Hughes
4,072,294 A 2/1978 Densen
4,106,150 A 8/1978 Irwin
4,133,283 A 1/1979 Ryan
4,143,740 A 3/1979 Matthews
4,149,701 A 4/1979 Densen
4,154,318 A 5/1979 Malleone
4,161,795 A 7/1979 Quest
4,168,764 A 9/1979 Walters
4,175,889 A 11/1979 Phaup et al.
4,280,243 A 7/1981 Durrant
4,315,839 A * 2/1982 Bouge ..... B01J 2/08 423/628
4,335,803 A 6/1982 Sugita
4,352,597 A * 10/1982 Kay ..... E02B 3/068 114/263
4,355,700 A 10/1982 Matthews et al.
4,419,851 A 12/1983 Kruger
4,424,752 A 1/1984 Aberg
4,527,366 A 7/1985 Greene et al.
4,630,709 A 12/1986 Taylor
4,712,264 A 12/1987 Voith
4,759,162 A * 7/1988 Wyse ..... E04H 3/24 52/126.6
4,768,497 A 9/1988 Winge
4,823,529 A * 4/1989 Canfield ..... E04F 15/024 52/712
4,838,735 A 6/1989 Warner
4,869,034 A 9/1989 Hammond
4,919,230 A 4/1990 Langer et al.
5,002,153 A 3/1991 Yuen
5,010,614 A 4/1991 Braemert et al.
5,031,723 A 7/1991 Hooten
5,077,852 A 1/1992 Karlsson
5,097,787 A 3/1992 Bruce
5,210,988 A 5/1993 Shaifer
5,319,818 A 6/1994 Baranowski
5,337,857 A 8/1994 Spalt et al.
D350,613 S 9/1994 Fahy, Jr.
5,402,546 A 4/1995 Baranowski
5,408,790 A 4/1995 Hoesten et al.
5,547,041 A 8/1996 Gispert
5,617,931 A 4/1997 Zygmun et al.
5,653,459 A * 8/1997 Murphy ..... B60R 3/007 280/166
5,779,208 A 7/1998 McGraw
5,794,292 A 8/1998 Ricci, Jr.
5,799,448 A 9/1998 Dunk
D406,363 S 3/1999 Molnar
5,911,288 A 6/1999 Zifirakis
5,950,266 A 9/1999 Streeter et al.
5,994,667 A 11/1999 Merdan et al.
6,032,590 A 3/2000 Chen
6,085,867 A * 7/2000 Daniel, III ..... E04F 11/112 182/115
6,170,609 B1 1/2001 Dech
6,390,152 B1 5/2002 Donovan et al.
6,425,572 B1 7/2002 Lehr
6,526,614 B2 3/2003 Anderson et al.
6,763,912 B2 7/2004 Robinson et al.
6,810,995 B2 11/2004 Warford
6,813,792 B2 11/2004 Miller
6,895,796 B2 5/2005 Hametner
6,918,464 B2 7/2005 Renton et al.
6,923,140 B1 8/2005 Cook
7,010,825 B1 3/2006 Salas et al.
7,159,261 B2 1/2007 Carrigan
7,197,372 B2 3/2007 Hazama
7,309,844 B2 12/2007 Lajoie
7,383,600 B2 6/2008 Carrigan
7,500,335 B1 3/2009 Kjose
D596,317 S 7/2009 Favell
D602,603 S 10/2009 Masser
D608,459 S 1/2010 Wyse
D619,445 S 7/2010 Wyse
7,950,095 B2 5/2011 Honeycutt et al.
8,046,858 B2 11/2011 Honeycutt
8,051,951 B2 11/2011 Bennett et al.
D664,270 S 7/2012 Curtin et al.
8,261,393 B2 9/2012 Honeycutt et al.
8,341,821 B2 1/2013 Honeycutt
8,387,191 B2 3/2013 Honeycutt
8,434,273 B1 5/2013 Greene
8,490,234 B2 7/2013 Rowell et al.
8,561,239 B2 10/2013 Honeycutt et al.
8,627,926 B2 1/2014 Gordon
8,746,403 B1 6/2014 Tyner et al.
8,813,430 B2 8/2014 Rees et al.
8,869,335 B2 10/2014 Honeycutt et al.
8,904,714 B2 12/2014 Montalto et al.
D737,464 S 8/2015 Edlington
9,321,489 B1 4/2016 Dauner
D785,206 S 4/2017 Ramphos et al.
10,358,871 B2 7/2019 Honeycutt
D872,310 S 1/2020 Honeycutt
D878,635 S 3/2020 Honeycutt
10,640,983 B2 5/2020 Honeycutt et al.
D890,957 S * 7/2020 Kuka ..... D25/63
10,736,304 B2 * 8/2020 Sarver ..... A01K 15/027
2001/0017233 A1 8/2001 Panzeri
2002/0003340 A1 1/2002 Hallquist
2002/0066290 A1 6/2002 Chen
2002/0189177 A1 12/2002 Eve et al.
2004/0050010 A1 * 3/2004 Fortier ..... E04B 1/003 52/650.3
2004/0107519 A1 6/2004 Grody
2004/0231920 A1 11/2004 Meeker
2005/0117969 A1 6/2005 Byrne et al.
2005/0193675 A1 9/2005 Smart et al.
2006/0137266 A1 6/2006 Whalen
2007/0125602 A1 6/2007 Marbach
2007/0161460 A1 7/2007 Katz et al.
2007/0278041 A1 12/2007 Cosgrove
2008/0202391 A1 8/2008 Pisano
2009/0144916 A1 6/2009 Honeycutt et al.
2009/0180853 A1 7/2009 Gang
2009/0293385 A1 12/2009 Vargas
2010/0031455 A1 2/2010 Honeycutt et al.
2010/0031456 A1 2/2010 Honeycutt et al.
2010/0032633 A1 2/2010 Honeycutt
2010/0242383 A1 9/2010 Maltini
2010/0294593 A1 * 11/2010 Gordon ..... E04F 11/02 182/115
2010/0326771 A1 12/2010 Kreller
2011/0047724 A1 3/2011 Honeycutt
2011/0198153 A1 * 8/2011 Dufour ..... E04G 5/02 182/113
2011/0225794 A1 9/2011 Honeycutt et al.

(56) References Cited

U.S. PATENT DOCUMENTS

| | | | | |
|---|---|---|---|---|
| 2011/0278094 | A1 | 11/2011 | Gute | |
| 2012/0073902 | A1 | 3/2012 | Honeycutt | |
| 2013/0015016 | A1* | 1/2013 | Honeycutt | E04G 5/14 182/113 |
| 2014/0367628 | A1 | 12/2014 | Hewson et al. | |
| 2015/0267470 | A1 | 9/2015 | Honeycutt | |
| 2017/0275888 | A1* | 9/2017 | Honeycutt | E04F 11/025 |
| 2019/0338529 | A1* | 11/2019 | Michels | E04B 1/2403 |
| 2019/0338592 | A1 | 11/2019 | Honeycutt | |
| 2020/0224427 | A1 | 7/2020 | Honeycutt et al. | |
| 2020/0299958 | A1* | 9/2020 | Oliver | E04F 11/181 |

FOREIGN PATENT DOCUMENTS

| | | | |
|---|---|---|---|
| CA | 2455312 | A1 | 7/2005 |
| CA | 2782880 | C | 5/2015 |
| DE | 19503543 | A1 | 8/1996 |
| DE | 20214211 | U1 | 1/2003 |
| DE | 20214212 | U1 | 1/2003 |
| DE | 20305795 | U | 6/2003 |
| DK | 200300195 | U3 | 8/2003 |
| EP | 0140984 | A1 | 5/1985 |
| EP | 1681226 | A2 | 7/2006 |
| FR | 2275724 | A1 | 1/1976 |
| FR | 2672917 | A1 | 8/1992 |
| GB | 945822 | A | 1/1964 |
| GB | 1082462 | A | 9/1967 |
| GB | 1212983 | A | 11/1970 |
| GB | 2185775 | A | 7/1987 |
| GB | 2275632 | A | 9/1994 |
| GB | 2318607 | A | 4/1998 |
| JP | H04277261 | A | 10/1992 |
| JP | H06100021 | B2 | 12/1994 |
| WO | 0148321 | A1 | 7/2001 |
| WO | 2005116369 | A1 | 12/2005 |
| WO | 2009076311 | A1 | 6/2009 |
| WO | 2009147004 | A1 | 12/2009 |

OTHER PUBLICATIONS

ErectaStep Mobile Work Platforms & Stairs (6 pgs.) 1901.
Vestil Manufacturing Corp. MP-Series Modular Steel Platform System Instruction Manual Sep. 7, 2017.
Graepel 2008 Product Range 2008.
FS Industries Engineered Steel Products Catalog. 2007 http://web.archive.org/web/20070811211253/https://www.fsindustries.com/more_info/closed_riser_diamond_plate__stair_treads/closed_riser_dia_plate_treads.shtml.
Grating Pacific. Products & Services Catalog. 2008.
Metals, Inc. Stair Treads Introduction. 2007 http://web.archive.org/web/20070821220107/http://metals-inc.com/frstair.htm.
"Multi-Access Component System Assembly Guide", Carbis Incorporated, 2002, modified in 2005.
Affidavit of Christopher Butler, office manager of Internet Archive, with printouts of webpages publicly available on Feb. 5, 2006 authenticating Aluminum Ladder Co., Alco-Lite Industrial Products.
Versa Step Nov. 23, 2015 from "https://web.archive.org/web/20151123141335/http://www.tri-arc.com/PDF/VersaStep.pdf".
Versa Step Aug. 13, 2007 from https://web.archive.org/web/20070813210132/http://www.tri-arc.com/PDF/VersaStep.pdf.
SafeRack catalog ErectaStep Crossovers and Modular Platforms. http___web.archive.org_web_20101230184849_http___www.saferack.pdf.
SafeRack extended product catalog. 2006.
SafeRack extended product catalog. 2004.
Carbis Solutions Group LLC., Modular Safety Platform System. https://www.carbissolutions.com/product/modular-platform-system/.
Carbis Solutions Group LLC., Modular Platform System Assembly Guide https://www.carbissolutions.com/wp-content/uploads/2017/08/MPS-Nov17.pdf.
Carbis, Inc. Catalog , May 1999.
Carbis, Inc. Catalog, Oct. 2000.
Carbis, Inc. Catalog, Oct. 2003.
Carbis, Inc. Catalog, 2011.
ErectaStep Modular Stair Components https://www.erectastep.com/metal-stair-components/.

* cited by examiner

MODULAR ACCESS SYSTEM

CROSS-REFERENCE TO RELATED APPLICATIONS

This application claims the benefit of U.S. provisional application No. 62/983,364 (the '364 application), filed 28 Feb. 2020, which is hereby incorporated by reference as though fully set forth herein. In addition, as to U.S. application Ser. No. 17/187,749, filed 27 Feb. 2021 (the '749 application), and U.S. application Ser. No. 17/187,752, filed 27 Feb. 2021 (the '752 application), the '749 application and the '752 applications are both hereby incorporated by reference as though fully set forth herein.

BACKGROUND a. Technical Field

The instant disclosure relates generally to modular access system improvements.

b. Background Art

This background description is set forth below for the purpose of providing context only. Therefore, any aspects of this background description, to the extent that it does not otherwise qualify as prior art, is neither expressly nor impliedly admitted as prior art against the instant disclosure.

It is known to provide equipment/systems configured to provide a safe walkway over a variety of obstacles, such as conveyors, machines, pipes, and the like. It would be desirable to the provide such equipment/systems that have increased flexibility in configuration to accommodate different uses.

The foregoing discussion is intended only to illustrate the present field and should not be taken as a disavowal of claim scope.

SUMMARY

Embodiments of a modular access system and components thereof are disclosed. In an embodiment, a modular access system includes first and second platforms each including an upper surface, four side surfaces extending from the upper surface to a lower edge thereof, and four lips extending from the lower edge of the side surfaces, the side surfaces each including first connection apertures, the lips each including second connection apertures, wherein the first and second platforms are connected together at a respective selected one of the four side surfaces using elongate fasteners extending through the first connection apertures to define a connection structure, the connected first and second platforms forming a platform assembly having first and second opposing lateral sides and first and second opposing longitudinal ends.

The modular access system further includes first and second support angles connected to the lips on the first and second lateral sides underneath the connection structure using elongate fasteners extending through the second connection apertures. The modular access system further includes a first pair of gussets at the first longitudinal end adjacent to the first and second support angles and mounted to the lips, the first pair of gussets including third connection apertures disposed at the first longitudinal end. The modular access system still further includes a second pair of gussets at the second longitudinal end adjacent to the first and second support angles and mounted to the lips, the second pair of gussets including fourth connection apertures disposed at the second longitudinal end. The modular access system still further includes a first stile assembly at the first longitudinal end and having fifth connection apertures, the first stile assembly being connected to at least the first pair of gussets using elongate fasteners extending through the third and the fifth aligned connection apertures. The modular access system further includes a second stile assembly at the second longitudinal end and having sixth connection apertures, the second stile assembly being connected to at least the second pair of gussets using elongate fasteners extending through the fourth and the sixth aligned connection apertures.

Embodiments of other systems, methods, and components thereof are presented.

The foregoing and other aspects, features, details, utilities, and advantages of the present disclosure will be apparent from reading the following description and claims, and from reviewing the accompanying drawings.

DETAILED DESCRIPTION

Various embodiments are described herein to various apparatuses, systems, and/or methods. Numerous specific details are set forth to provide a thorough understanding of the overall structure, function, manufacture, and use of the embodiments as described in the specification and illustrated in the accompanying drawings. It will be understood by those skilled in the art, however, that the embodiments may be practiced without such specific details. In other instances, well-known operations, components, and elements have not been described in detail so as not to obscure the embodiments described in the specification. Those of ordinary skill in the art will understand that the embodiments described and illustrated herein are non-limiting examples, and thus it can be appreciated that the specific structural and functional details disclosed herein may be representative and do not necessarily limit the scope of the embodiments.

Reference throughout the specification to "various embodiments," "some embodiments," "one embodiment," or "an embodiment," or the like, means that a particular feature, structure, or characteristic described in connection with the embodiment is included in at least one embodiment. Thus, appearances of the phrases "in various embodiments," "in some embodiments," "in one embodiment," or "in an embodiment," or the like, in places throughout the specification are not necessarily all referring to the same embodiment. Furthermore, the particular features, structures, or characteristics may be combined in any suitable manner in one or more embodiments. Thus, the particular features, structures, or characteristics illustrated or described in connection with one embodiment may be combined, in whole or in part, with the features, structures, or characteristics of one or more other embodiments without limitation given that such combination is not illogical or non-functional.

Figure 1:
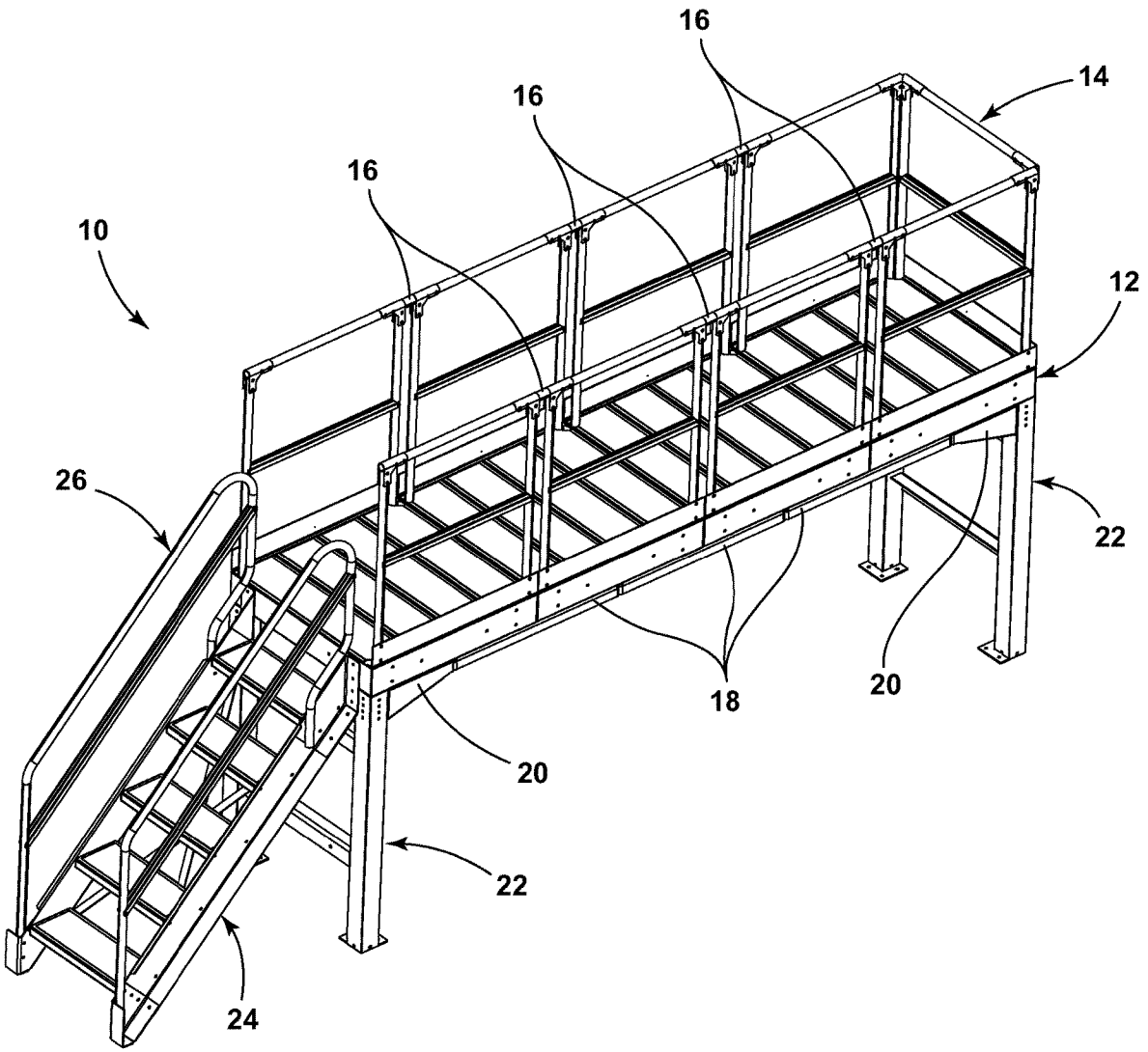
FIG. 1 is an isometric view of a modular access system, in an embodiment.

Referring now to the drawings wherein like reference numerals are used to identify identical or similar components in the various views, FIG. 1 is an isometric view of an embodiment of a modular access system 10 in accordance with a first embodiment. System 10 includes a platform 12 (or multiple platforms as described below), a plurality of guardrail (GR) assemblies 14 connected by way of a plurality of guardrail connector assemblies 16, a plurality of platform support angle members 18 (hereinafter support angle(s)), left-hand side and right-hand side platform supports 20 (hereinafter gusset(s)) at each longitudinal end of the system 10, a pair of towers 22 configured to elevate the platforms above ground/grade, a pair of stile assemblies 24—one shown at one longitudinal end, wherein each stile assembly 24 includes a respective handrail assembly 26 associated therewith.

Figure 2:
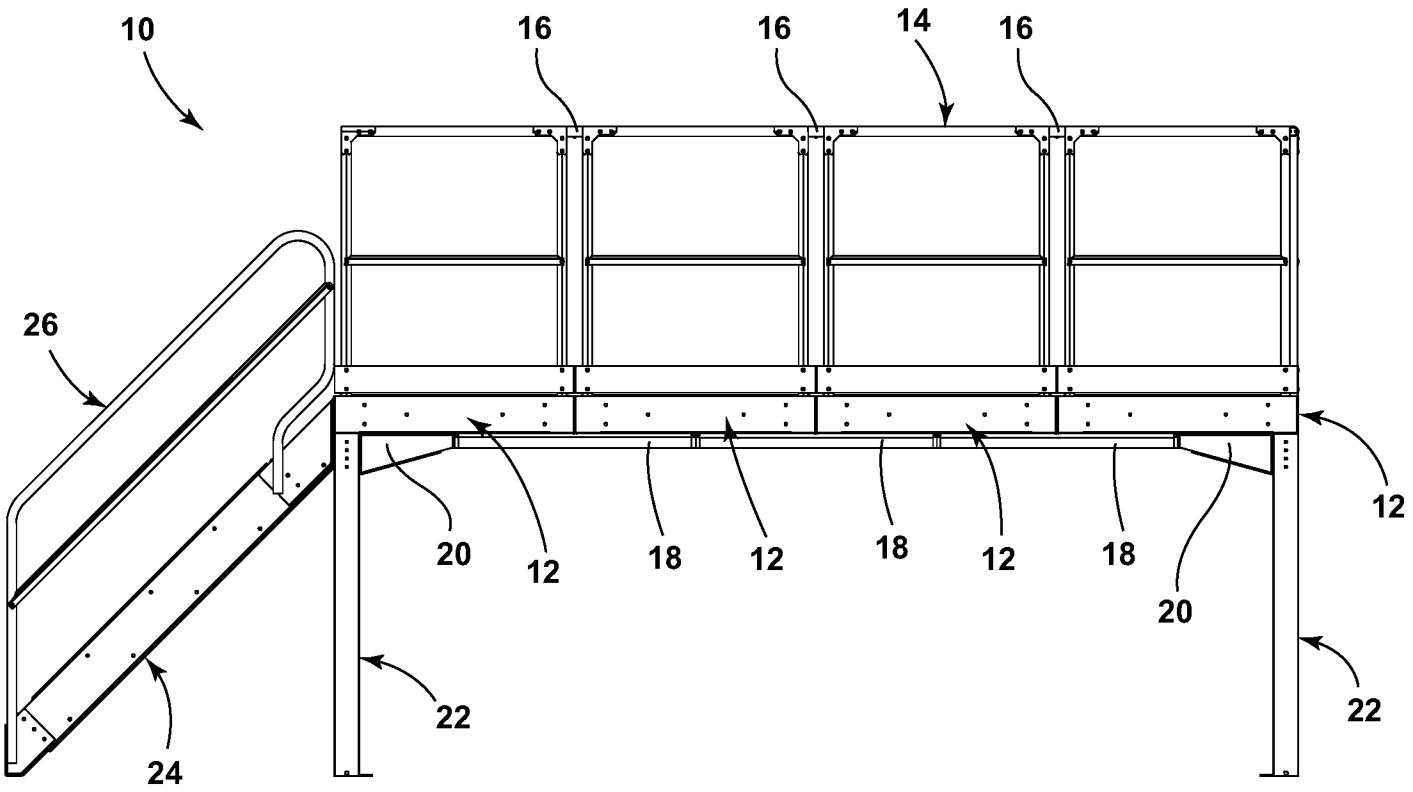
FIG. 2 is a side view of the modular access system of FIG. 1.

FIG. 2 is a side view of the modular access system 10 of FIG. 1.

Figure 3:
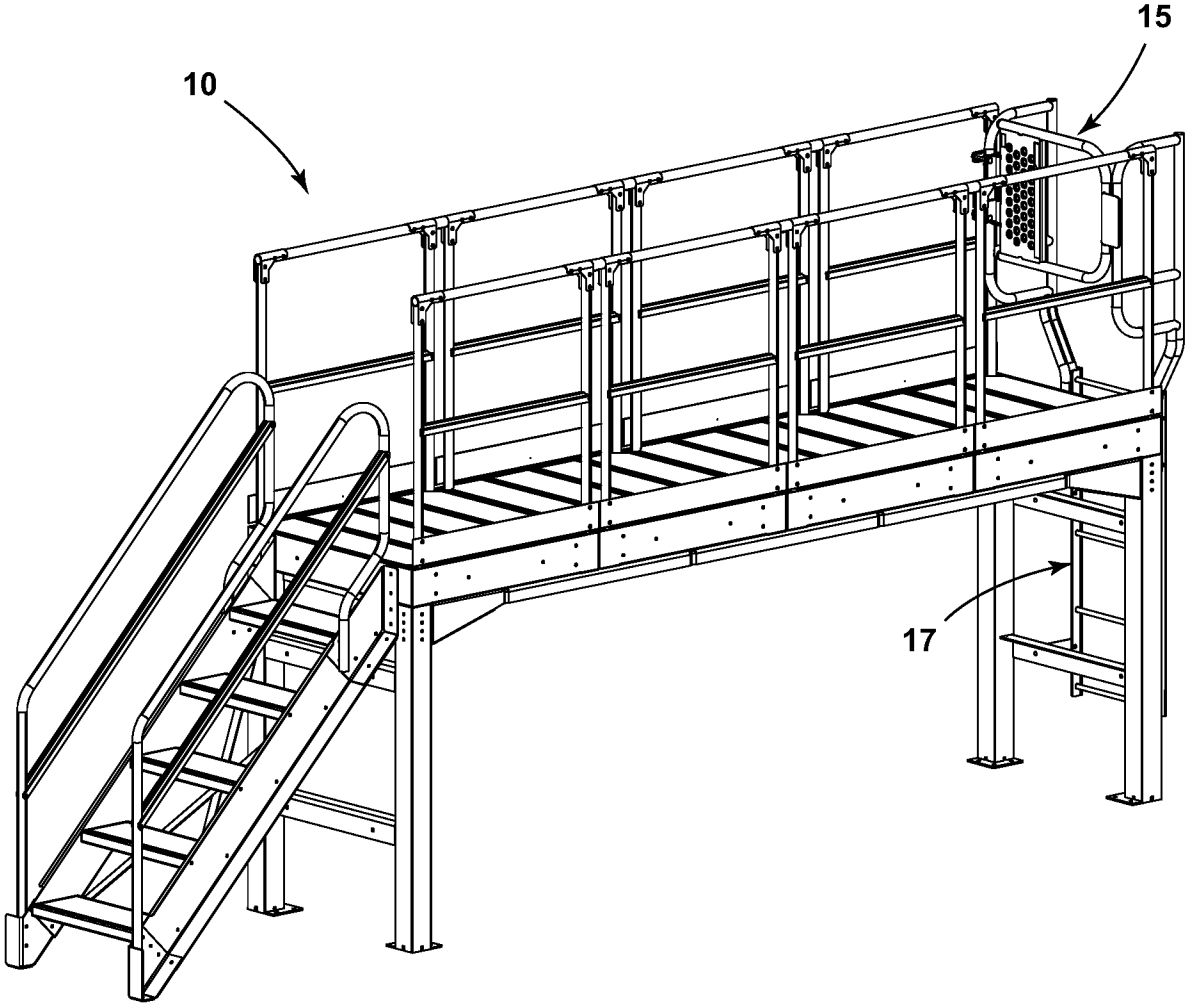
FIG. 3 is an isometric view showing another embodiment of a modular access system, including a stile assembly, a fixed ladder, and a safety gate.
Figure 4B:
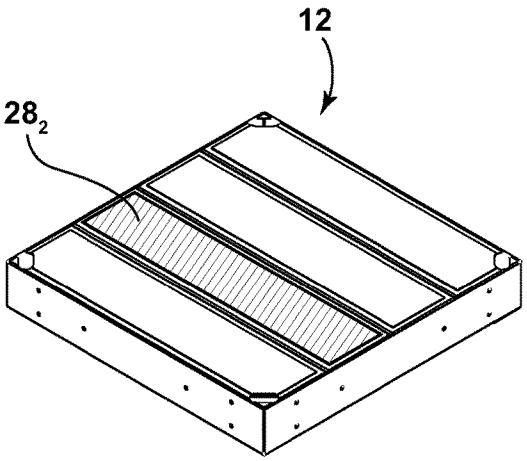
FIGS. 4A-4D are isometric, diagrammatic views of a platform as in FIG. 1 illustrating that the platform comprises four individual box segments, in an embodiment.
Figure 4D:
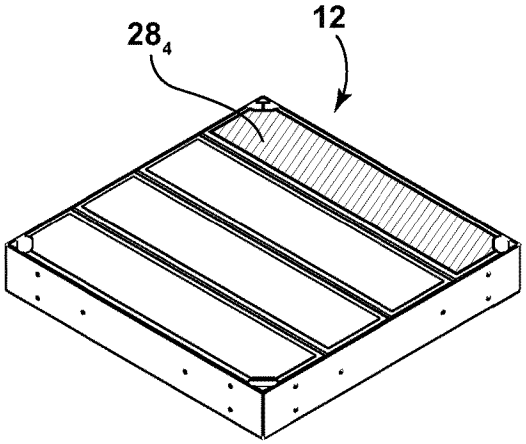
Figure 4A:
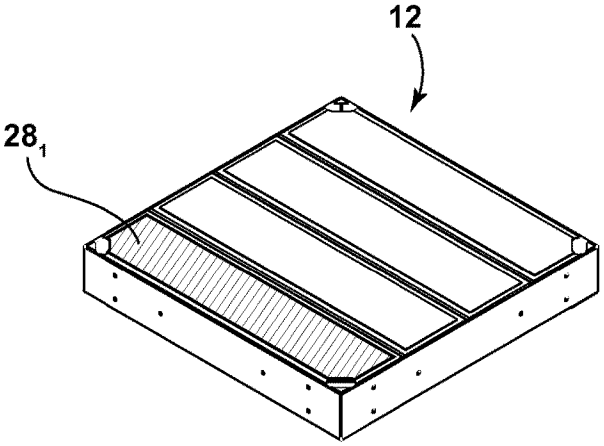
Figure 4C:
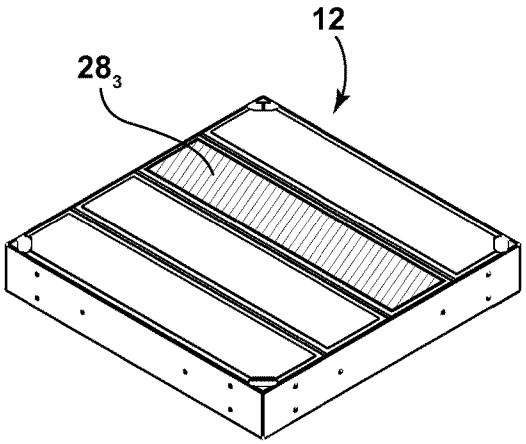

FIG. 3 is an isometric view of a further embodiment of system 10, namely, a 2-platform embodiment and further including a safety gate 15 in lieu of a guardrail assembly 14, which is attached to a longitudinal end of the system 10 that is opposite of the stile assembly 24. FIG. 3 further shows that a fixed ladder (FL) 17 can be attached to the platform assembly such as to the tower horizontal members (more below) so as to provide a different configuration suitable to another use case.

Modular access system embodiments consistent with the instant disclosure may be configured to include at least five major components, including but not limited to one or more platform(s) 12, one or more stile assemblies 24, one or more towers 22, one or more guardrail (GR) assemblies 14, and one or more fixed ladder(s) 17. Generally, in an embodiment, the platforms may be 38"×38" in size and are configured to be attached to each other on any of its four sides and in an embodiment, may be configured in spans up to four platforms between towers 22 or stile assemblies. Also generally, in embodiments, the stile assemblies 24 may be configured in two (2) through six (6) step configurations, although this range is exemplary only and not limiting in nature. Also generally, in embodiments, the high-strength towers maintain the modular access system 10 strong and stable. For example, in an embodiment, four (4) platforms 12 may be spanned between towers 22 and the tower lower ends may be configured to be bolted down to an underlying structure for stability. Further generally, in embodiments, the guardrail assemblies 14 may be configured using 1.5 inch tube and having a 4 inch toeboard to keep personnel safe and secure on the platform surface. The fixed ladder 17 can be mounted in a plurality of different locations on the modular access system 10 to provide stable, safe and easy access in areas where a stile assembly 24 with steps may not fit, and can include fixed ladder (and components and embodiments thereof) as seen by reference to the '752 application described above. The components of the modular access system 10 may be made of metal, such as steel or aluminum, and in embodiments, made of steel. In an embodiment, the system 10 may support a load of up to 1,000 pounds between towers or twenty-five pounds per square foot on four platforms.

The flexibility of the system 10 allow for a customized configuration to allow the user to build a tailored walkway that fits around and/or over a large variety of structures. In other words, the modular access system 10 is configured to provide a safe walkway for a user over a variety of obstacles, such as conveyors, machines, pipes, and the like. The top surface of the platforms provide such a walkway for a user.

In further embodiments, improved tread configuration(s) may be included in the stile assembly 24 to provide increased slip-resistance (including perforated nosing) for added grip and high visibility to increase user confidence and safety while ascending or descending such treads, as seen by reference to the '749 application described above.

Platform 12. FIGS. 4A-4D are isometric views of platform 12. As shown in the illustrative embodiment, platform 12 comprises four individual box segments respectively designated $\mathbf{28}_1$, $\mathbf{28}_2$, $\mathbf{28}_3$, and $\mathbf{28}_4$, which are joined together (e.g., by welding) along with some additional structures to be described below in order to form a box structure for platform 12.

Figure 5:
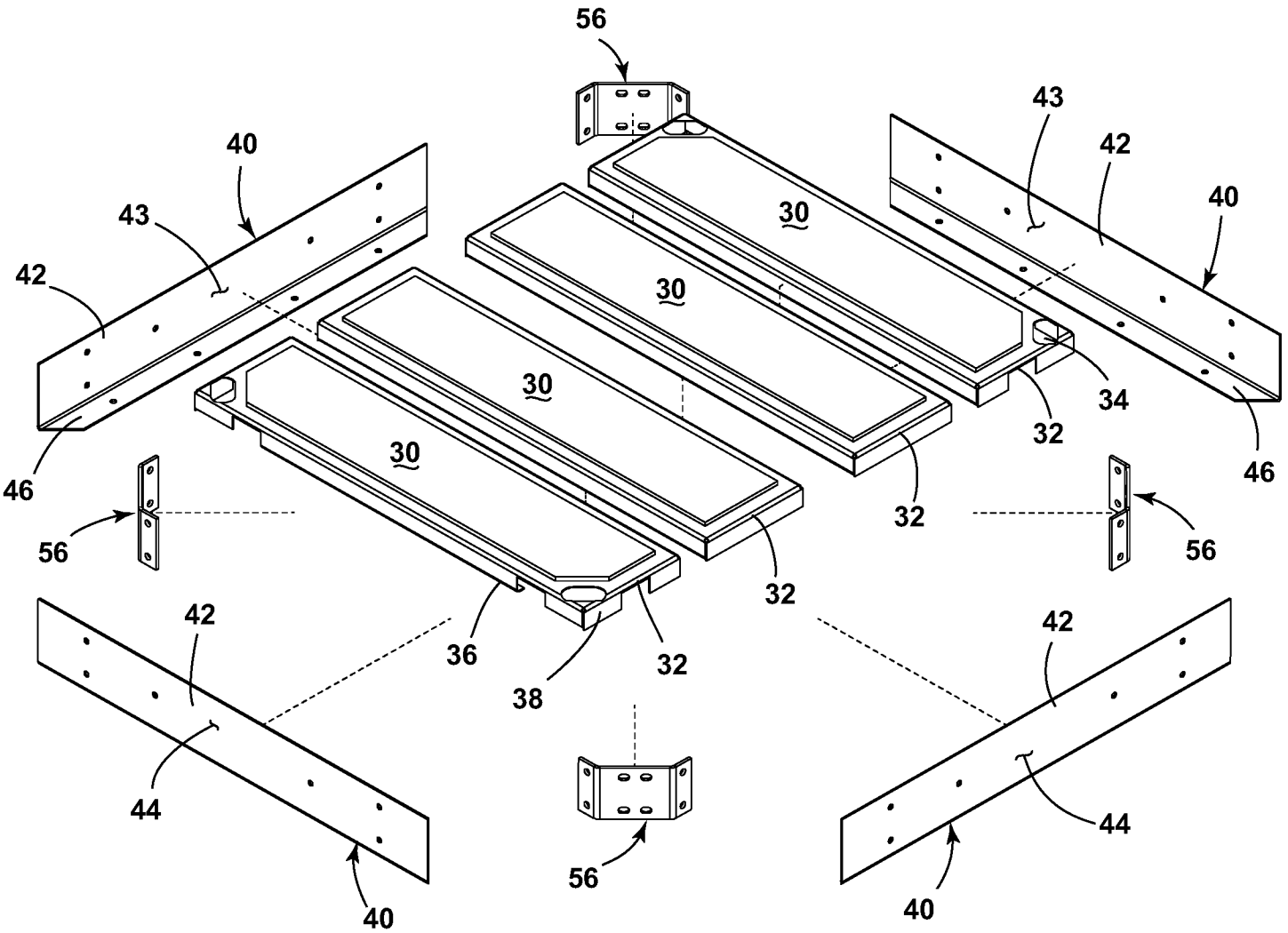
FIG. 5 is an isometric, exploded view of the platform of FIGS. 4A-4D as seen from the top, in an embodiment.

FIG. 5 is an isometric, exploded view of platform 12 as seen from the top, in an embodiment, and showing constitute components thereof. Each box segment 28 includes a respective upper or top surface 30 of a tread 32 wherein the top surface 30 includes cutouts 34 configured to receive lower ends of guardrail vertical posts (more below). The tread 32 may be selected from a plurality of different options to suit the particular use of/needs for the modular access system 10. For example only, the tread 32/surface 30 may include finishing treatment such as powder coating, painting or the like for corrosion resistance, and may further include a wide range of anti-skid features (not shown in FIG. 5) such as perforations, serrations, now known or hereinafter developed, and may include one of the tread configurations set forth in the '749 application described above. Each box segment 28 further includes a rectangular frame having four sidewall, specifically a pair of opposite, long sidewalls 36 and a pair of opposite, short sidewalls 38 that together define a perimeter wall. It should be appreciated that the rectangular frame may integrally formed with the tread 32 or may be of separate construction and to which the tread 32 is later joined. In an embodiment, the two walls 36, 38 (i.e., two pairs of opposite sidewalls 36, 38) of the tread 32 are made from a continuous sheet of material.

Figure 6:
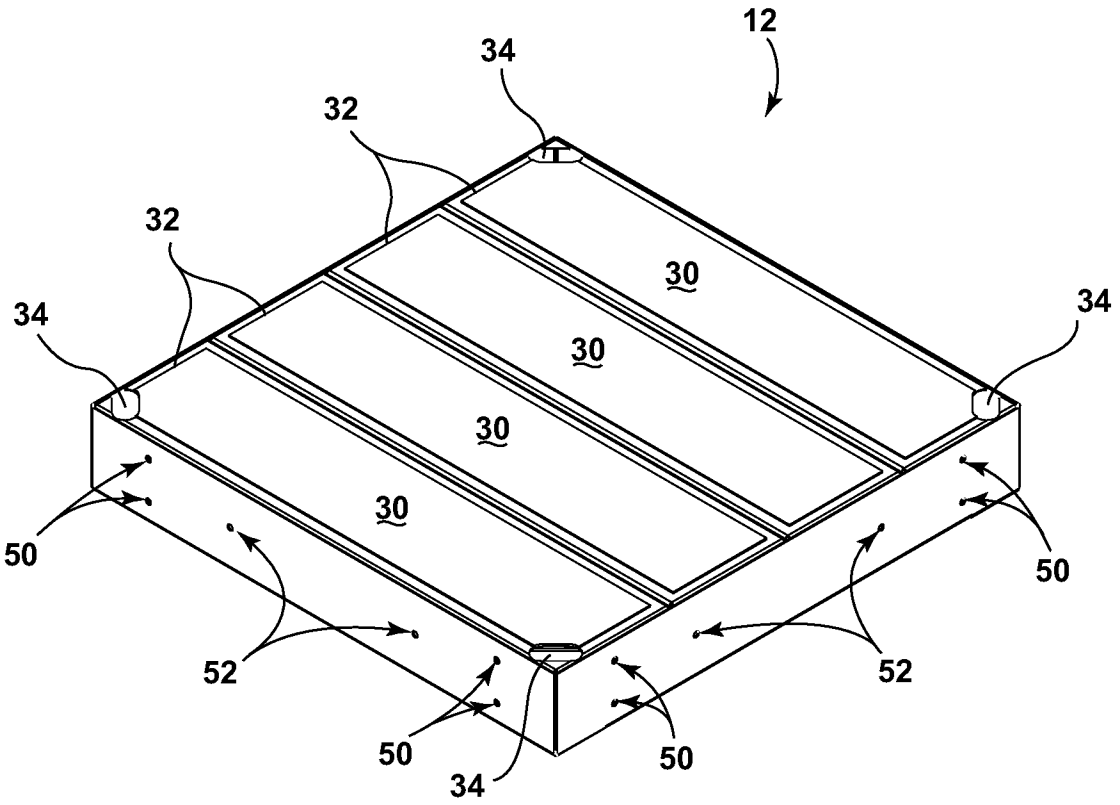
FIG. 6 is an isometric view of the platform of FIG. 5 as seen from the top in an assembled state.

Each platform 12 also includes four side members 40 forming a box having four corners, both inside corners and outside corners. Each side member 40 is generally L-shaped in cross-section and having a first, vertical leg 42 having an inside/internal surface 43 and an external surface 44, and a second, horizontal leg defining a lip 46 having a first, external and downwardly facing surface 48 (best shown in the bottom view in FIG. 7). The bend between vertical leg 42 and lip 46 defines a lower edge of the side member 40 of the platform 12 in the assembled form (FIG. 6). The lip 46 therefore is generally horizontal and parallel to but spaced apart from the top surface 30 of the platform 12.

Additionally, both leg 42 and lip 46 have a respective plurality of through-holes or apertures configured to facilitate various mechanical connections, as will be described in greater detail below. In an embodiment, the side members 40 are generally identical. In an embodiment, each side member 40 may be about 5.75 inches in vertical height, although it should be understood that this is exemplary only and not limiting in nature. Additionally, each platform 12 includes four corner brackets 56 wherein sidewalls 36, 38 include cut-out regions in order to accommodate the legs of the corner brackets 56, i.e., the cutouts are there to ensure that the corner bracket 56 sits flush on the wall of the box side member 40, and also allows the tread to sit down into the box with clearance for the corner bracket 56. The bracket legs may be connected to the side members (e.g., by welding).

The components of FIG. 5 may be formed of a durable material such as a metal for example steel or aluminum. In terms of joining the separate components, the box segments 28 can be joined to each other and to the side members 40 using conventional approaches such as by welding. The corner brackets 56 can also be attached by welding.

FIG. 6 is an isometric view of platform 12 as seen from the top, in an assembled and joined state relative to FIG. 5. As described above in connection with tread 32/surface 30, the other surfaces of platform 12 may also include finishing treatment such as powder coating, painting or the like for corrosion resistance.

Each side member 40 of the assembled platform 12 includes a number of through apertures, for example in the illustrative embodiment, first and second pairs of apertures 50 located at lateral ends (left and right) and a pair of spaced apart apertures 52. Fasteners such as elongate threaded fasteners (not shown in FIG. 5) can be used in cooperation with apertures 50, 52 to connect adjacent platforms 12 to produce a platform assembly. The first and second aperture pairs 50 may be used in connection with elongate fasteners to connect a stile assembly 24 to the platform 12 as described below.

With continued reference to FIG. 6, the platform 12 also includes four through holes or cutouts 34 formed in the top surface(s) 30, which are configured in size and shape to allow insertion of the vertical posts of a guardrail assembly to be described.

Figure 7:
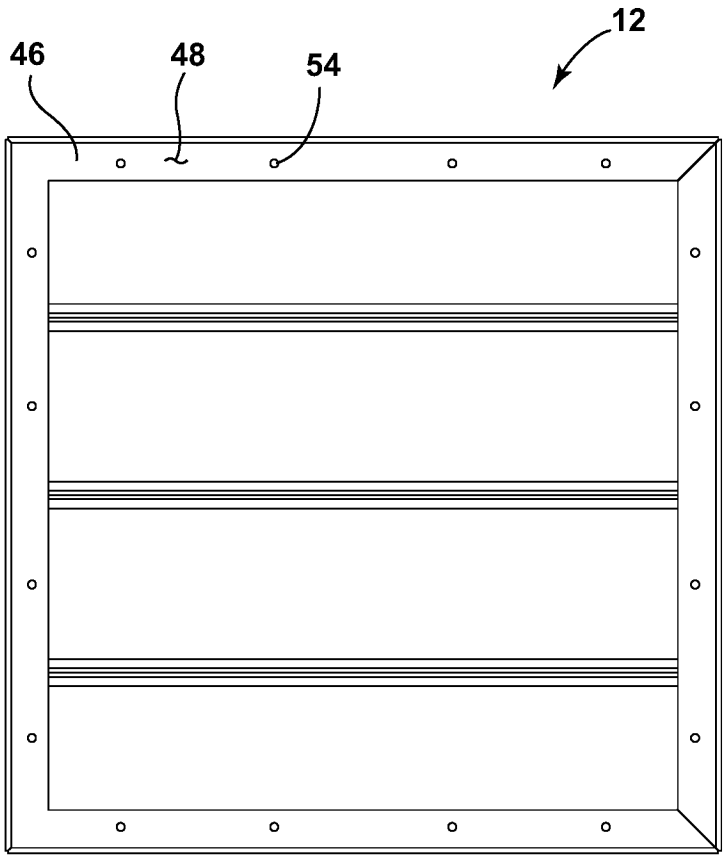
FIG. 7 is a bottom view of the platform of FIG. 6.

FIG. 7 is a bottom view of platform 12. As illustrated, each lip 46 includes an external and downwardly-facing surface 48 in which are formed a plurality (e.g., four) of through-going apertures such as holes 54. As will be described below, the holes 54 are used to facilitate connection of additional platform support components.

Figure 10:
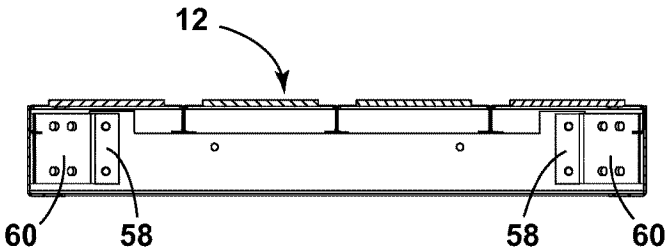
FIG. 10 is a cross-sectional view of the platform of FIG. 8 taken substantially along lines 10-10.
Figure 8:
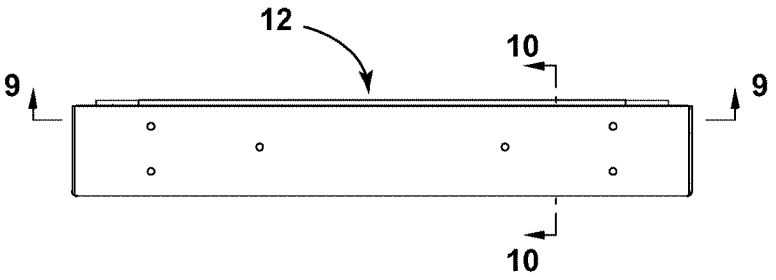
FIG. 8 is a front elevation view of the platform of FIG. 6.
Figure 9:
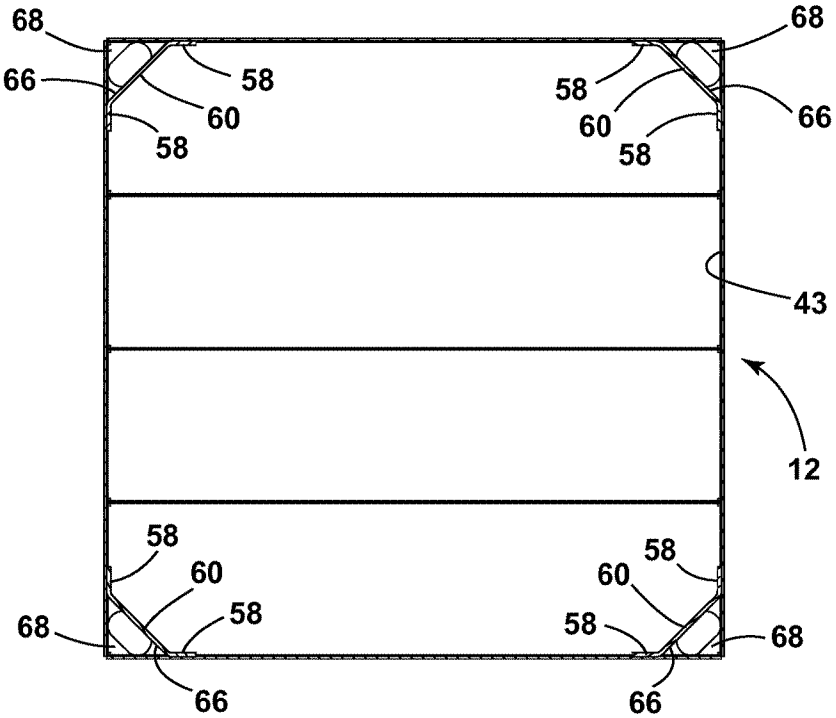
FIG. 9 is a cross-sectional view of the platform of FIG. 8 taken substantially along lines 9-9.

FIG. 8 is a front elevation view of platform 12 including cross-sections lines 9-9 and 10-10 which are shown in FIGS. 9-10, respectively.

FIG. 9 is a cross-sectional view of platform 12 taken substantially along lines 9-9 in FIG. 8. As shown, platform 12 includes four corner brackets 56 (truss plates) with one bracket 56 disposed in each inside corner of platform 12. Each corner bracket 56 includes a pair of legs 58 extending into a central portion 60. Each corner bracket 56 may be connected (e.g., via welding at points proximate legs 58) to the inside surfaces of the side members 40 of platform 12.

FIG. 10 is a cross-sectional view of platform 12 taken substantially along lines 10-10 of FIG. 8. FIG. 10 shows two corner brackets 56 contained in platform 12 and situated below surface 30 in an interior of the platform 12.

Figure 11:
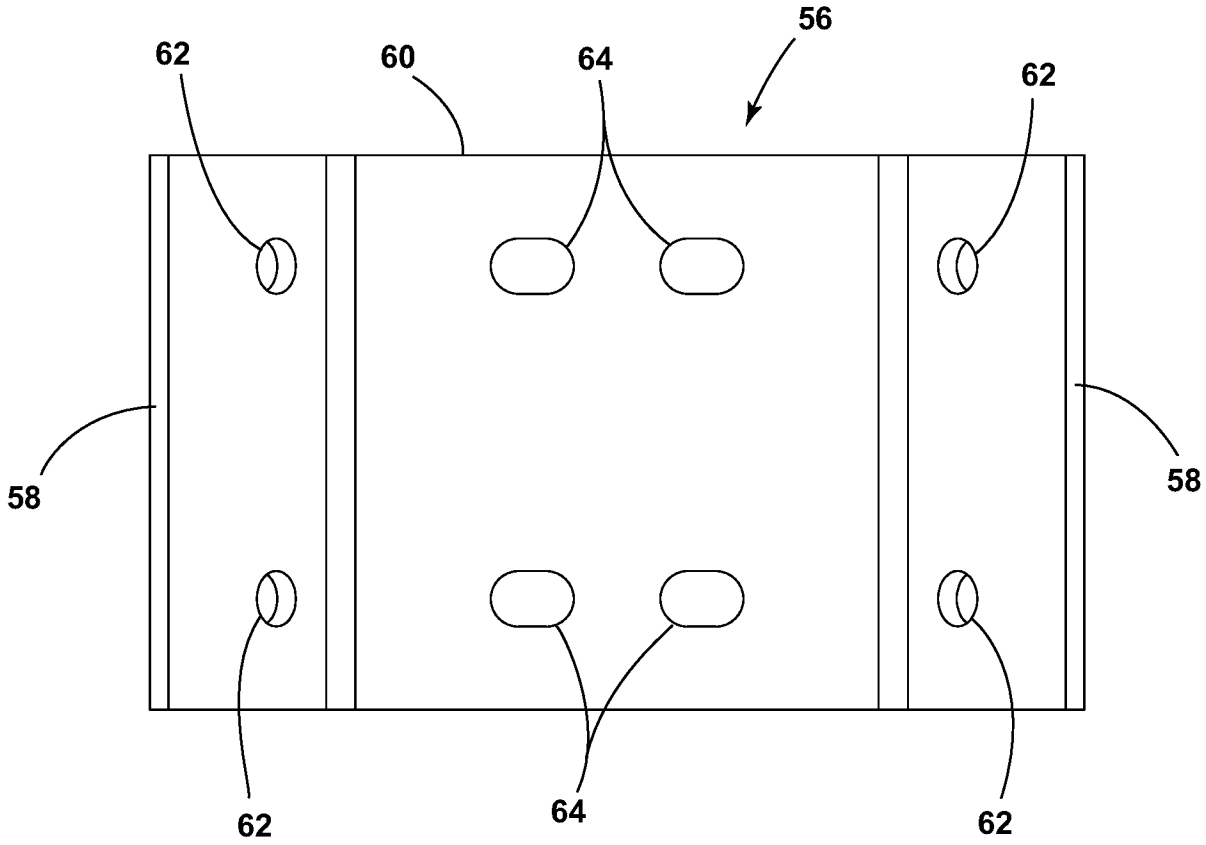
FIG. 11 is an enlarged, front view of a platform corner bracket (truss plate) shown in FIG. 5.

FIG. 11 is an enlarged, front side view of the bracket 56, in an embodiment. Each leg 58 of corner bracket 56 includes a respective pair of apertures such as holes 62. When the corner bracket 56 is installed in platform 12, holes 62 will be aligned with (in registry with) holes 50 in the sidewalls of the platform 12. Additionally, each corner bracket 56 includes first and second pairs of apertures such as slots 64 (i.e., four total slots) configured to allow for the connection of guardrail vertical posts (more below) to corner bracket 56 and thus to the platform 12.

With reference again to FIG. 9, the central portion 60 of each corner bracket 56 has a rearward facing surface 66. The inwardly-facing surfaces of the platform corners (i.e., the inner surfaces of side members 42) and the rearward facing surfaces 66 of corner brackets 56 together define a respective cavity 68. Each cavity 68 resides directly below a respective one of the cutouts 34.

Figure 12:
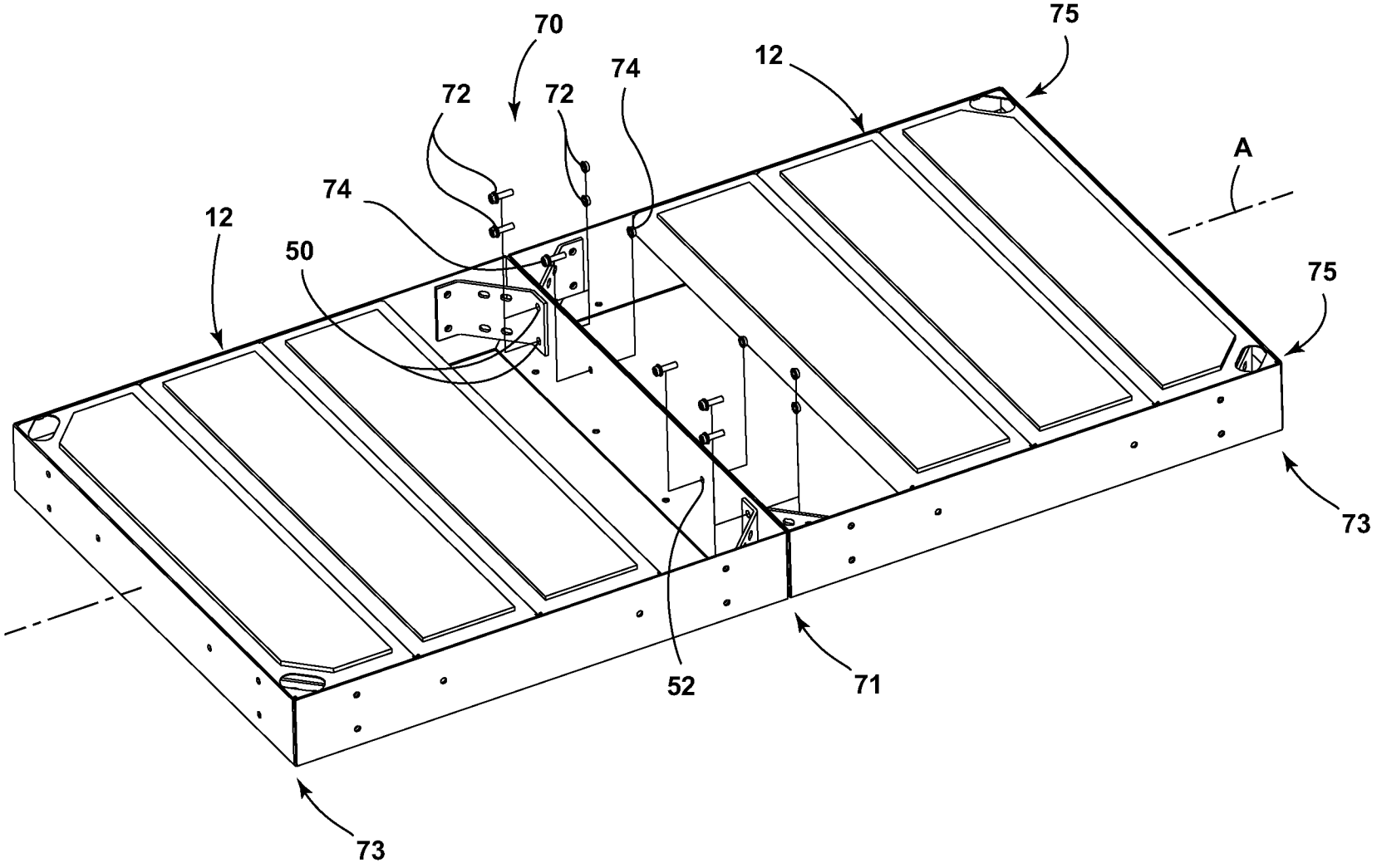
FIG. 12 is a isometric and partially exploded view, with portions broken away, showing the connection aspects between first and second platforms, in an embodiment.

Platform-to-Platform Connection. FIG. 12 is a isometric and partially exploded view, with portions broken away, showing connection aspects between a first platform 12 and an adjacent, second platform 12 to form a platform assembly 70, in an embodiment. The platform assembly 70 extends along a longitudinal axis (designated "A") and thus includes longitudinal ends 73, as formed, as well as lateral sides 75. The platform assembly 70 may be formed as follows. First, a selected one of the four sides of the first platform 12 is abutted up against a selected one of the four sides of the second platform 12, as shown. Second, fasteners such elongate threaded bolts 72 are inserted through apertures 62 (of bracket 56) and apertures 50 (of side member 40) of both platforms 12 and then secured using cooperating threaded nuts. Third, fasteners such as elongate threaded bolts 74 are inserted through apertures 52 of both platforms 12 and then secured using cooperating threaded nuts. It should be understood that the insertion of the fasteners 72, 74 can occur in any order. It should be understood that the use of bolts/nuts in the illustrated embodiment constitute removable fasteners, which can allow disassembly for redeployment, replacement, refurbishment, and the like.

As a result of the foregoing, a connection structure 71 is formed at an interface where platform side surfaces 44 engage each other and include the fasteners 72, 74 themselves as part of the connection structure 71. Also, as noted above, the platform assembly 70 extends along a longitudinal axis "A" and thus includes longitudinal ends 73 (i.e., the platform sides that are opposite of those used in forming the connection structure 71). And while the platform assembly 70 of FIG. 12 includes two platforms 12, further platforms 12 may be connected to extend the platform assembly 70, for example only, for a grand total of four platforms 12, in an embodiment. In other words, in an embodiment, a modular access system 10 can have four platforms 12 connected along an axis (e.g., as in FIG. 1) between any two towers 22 and, in addition, a modular access system 10 can have four platforms can be connected along an axis between two stile assemblies without any towers (e.g., see FIG. 44A which shows two connected platforms between two stile assemblies without any towers—in an embodiment, therefore, up to four platforms can be so connected). This feature, particularly the towerless embodiment (e.g., FIG. 44A) has the advantages of being rigid, strong, and the ability to span greater lengths/areas which can address and provide a solution to a variety of access problems (e.g., increases size/extent of the obstacles over which embodiments of system 10 can span). It should be understood that the foregoing is exemplary only and not limiting in nature (i.e., 1-platform, 2-platform, 3-platform, and 4-platform length span embodiments are contemplated).

Figure 13:
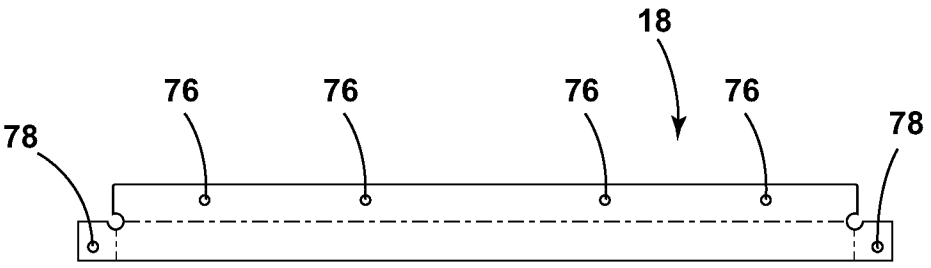
FIG. 13 is a top view of a flat pattern piece of material configured to be formed into a platform support angle member (support angle), in an embodiment.

Support Angle 18. FIG. 13 is a top view of a flat pattern piece of material in an embodiment that is configured to be formed into support angle 18 (i.e., before the flat pattern is bent along the bend lines—shown as dashed lines). The flat pattern when bent along the bend or fold lines form a generally L-shaped support angle 18. One leg of the support angle 18 includes apertures 76, which are used in combination with elongate fasteners to connect the support angle 18 to the lip 46 of platform 12. The support angle 18 spans the mechanical connection structure 71 formed between adjacent platforms 12 in order to increase support and strength at the location of the connection structure 71, including providing increased strength at the lateral edges of the platforms 12 where the support angle 18 is connected. For example, in the connected platforms 12 of FIG. 12, two support angles 18 would be installed—one for each lateral side of the resulting 2-platform assembly 70. Should the platform 70 include additional platforms 12, then additional support angles 18 would be used—one for each lateral side for all connection structures 71. For example, wherein three (3) platforms 12 are connected, two connection structures 71 will be formed, and thus two additional support angles 18 (one per side) would be used.

The support angle 18 further includes side flanges having respective apertures 78, which apertures are used in combination with elongate fasteners to connect adjacent support angles 18 and/or to connect a support angle 18 with an adjacent gusset as the case may be (more below).

Figure 14:
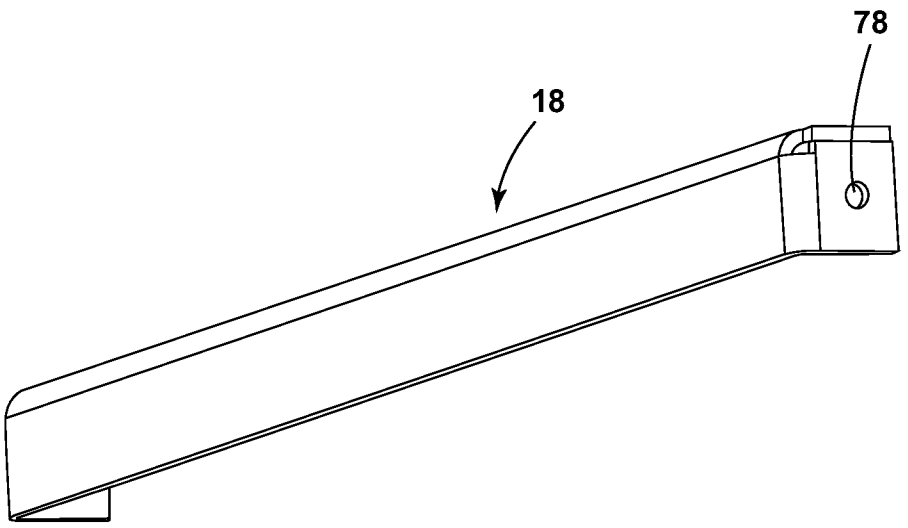
FIG. 14 is an isometric view of the support angle after the flat pattern of FIG. 13 has been bent along the designated bend lines (dashed lines).

FIG. 14 is an isometric view of support angle 18, after the flat pattern of FIG. 13 has been folded along the designated bend lines (dashed lines). More particularly, the flat pattern of FIG. 13 is folded approximately ninety degrees about the respective bend or fold lines in order to arrive at the support angle shown in FIG. 14. As shown, support angle 18 is a generally elongate item, and may comprise a durable and strong material like a metal, and particularly such as steel or aluminum.

Figure 15:
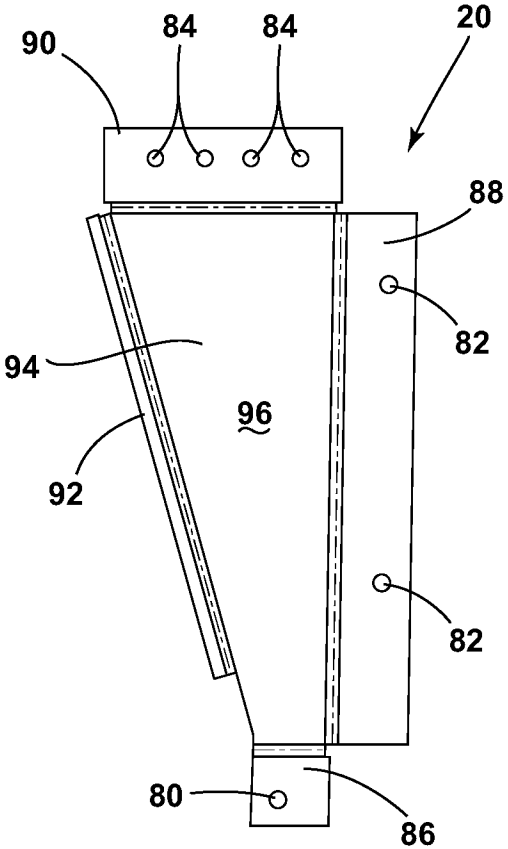
FIG. 15 is a top view of a flat pattern piece of material configured to be formed into a platform support (gusset) in a first embodiment as shown in FIG. 1 by bending along the designated bend lines (dashed lines).

Gussets 20. FIG. 15 is a top view of a flat pattern piece of material configured to be formed into a platform support member 20 (hereinafter a gusset 20) in a first embodiment. Like with the support angle 18, gusset 20 is formed by bending/folding the flat pattern along the designated bend lines (dashed lines). The gusset 20 includes through-apertures such as holes 80, 82, and 84 formed in inboard, top, and outboard portions 86, 88, and 90, respectively. Gusset 20 further includes a lip 92. The inboard, top, outboard, and lip portions 86, 88, 90, and 92 extend from a central portion 94 having an outer surface 96. Each of the portions 86, 88, 90, and 92 are bent along the designated bend lines (dashed lines) approximately ninety degrees.

The apertures 82 are used to connect the gusset 20 to the lip 46 (i.e., the underside of platform 12). The apertures 84 are used to connect the gusset 20 to a vertical member of tower 22. The aperture 86 is used to connect the gusset 20 to an adjacent support angle 18. It should be understood that apertures 82, 84, and 86 align with corresponding apertures in the adjacent support angle 18, in the lip 46 of the platform 12, and in the tower 22, respectively.

Figure 16A:
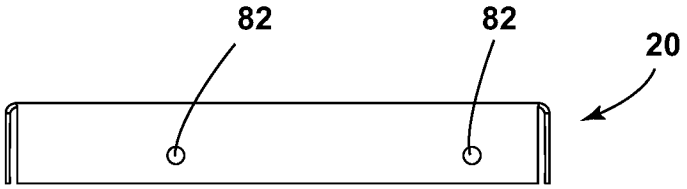
FIGS. 16A-16C are top, side, and bottom views of the platform support (gusset) of FIG. 15 after bending.
Figure 16B:
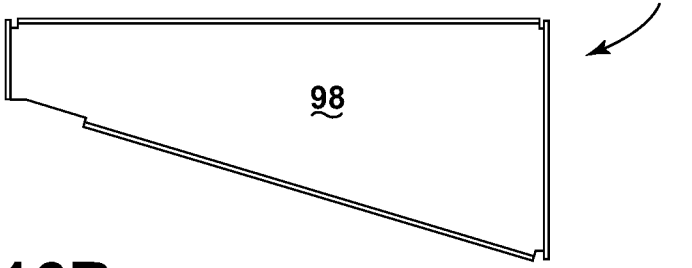
Figure 16C:
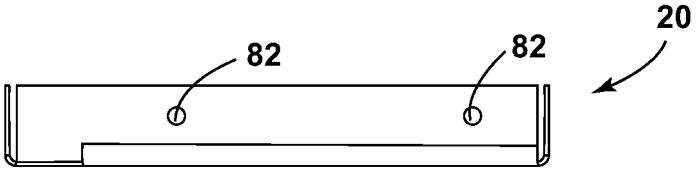

FIGS. 16A-16C are top, rear side, and bottom views of gusset 20. In particular, FIG. 16B shows a rear surface 98 opposite the front surface 96. The gusset 20 that is shown in FIGS. 15 and 16A-16C is the right gusset 20—the left gusset would of an opposite configuration.

Support Angle 18 & Gusset 20-To-Platform 12 Connections. FIG. 17A is an isometric, partially exploded view of a platform assembly 70 including first and second platforms 12, a pair of support angles 18 (one visible on the forward side), a pair of right-hand gussets 20 (one visible) and a pair of left-hand gussets 20, in an embodiment.

Figure 17C:
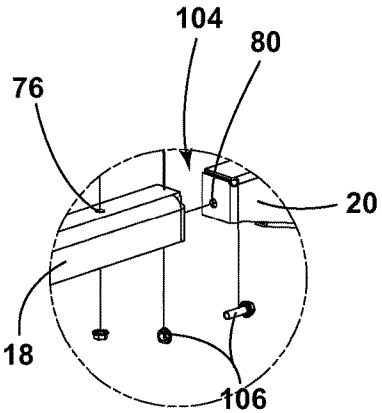
FIG. 17C is an isometric, enlarged view of a portion of FIG. 17A showing in greater detail the connection of a support angle and a gusset.
Figure 17A:
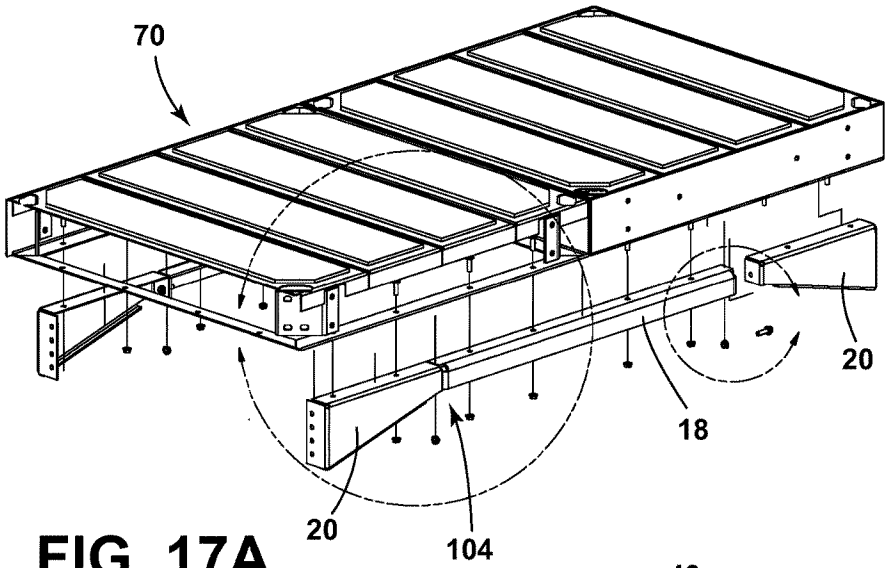
FIG. 17A is an isometric, partially exploded view of a platform assembly including first and second platforms, support angles, and pairs of right-hand and left-hand side platform supports (gussets), in an embodiment.
Figure 17B:
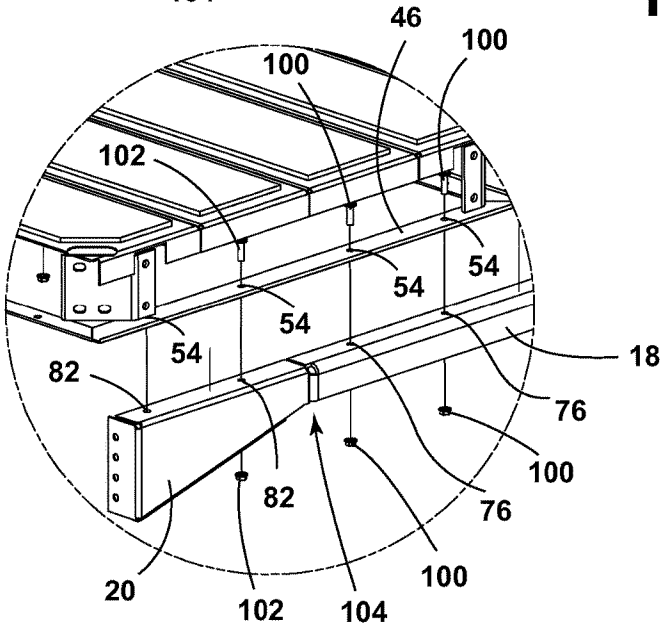
FIG. 17B is an isometric, enlarged view of a portion of FIG. 17A showing in greater detail the connections of a support angle and a gusset to a platform.

FIG. 17B is an isometric, enlarged view of a portion of FIG. 17A showing in greater detail the connections of support angle 18 and gusset 20 to platform 12. The holes 76 of the support angle 18 are aligned with the holes 54 of lip 46, wherein elongate fasteners 100 such as threaded bolt and cooperating threaded nuts are inserted through the aligned holes and are used to connect support angle 18 to the platform 12. This is done for all four holes 76 in the support angle 18 (shown in FIG. 17A). Likewise, the holes 82 of the gusset 20 are aligned with the holes 54 of the lip 46 wherein elongate fasteners 102 such as threaded bolt and cooperating threaded nuts are inserted through the aligned holes and are used to connect the gusset 20 to the platform 12. Additionally, the hole 78 of the support angle 18 is aligned with the hole 80 of the gusset 20 at interface 104, wherein an elongate fastener (not shown in FIG. 17B but see FIG. 17C for a threaded bolt and cooperating nut 106) is inserted through the aligned holes and is used to connect the gusset 20 to the support angle 18.

FIG. 17C is an isometric, enlarged view of a portion of FIG. 17A showing in greater detail the connection of support angle 18 and gusset 20. This is done by aligning holes 78 (not visible) and 80 wherein an elongate fastener, such as threaded bolt and cooperating nut combination 106, is inserted therethrough and secured.

It should be understood that the foregoing connections using elongate fasteners are made with respect to all the support angles 18 and gussets 20 included in any particular configuration of modular access system 10.

Figure 19:
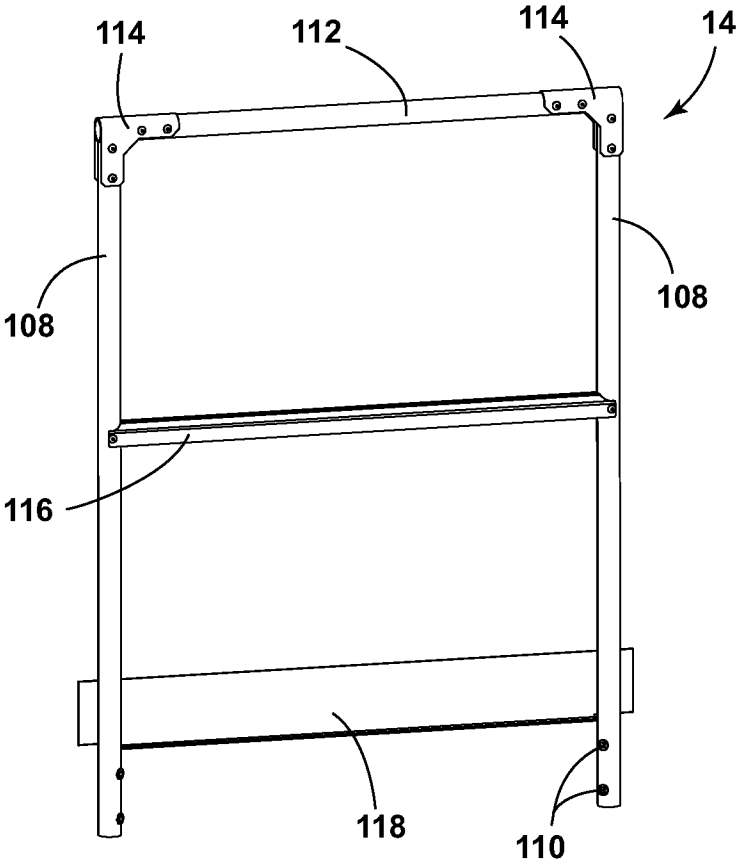
FIGS. 18-19 are isometric front and rear views, respectively, of a multi-piece guardrail (GR) assembly of FIG. 1, in an embodiment.
Figure 18:
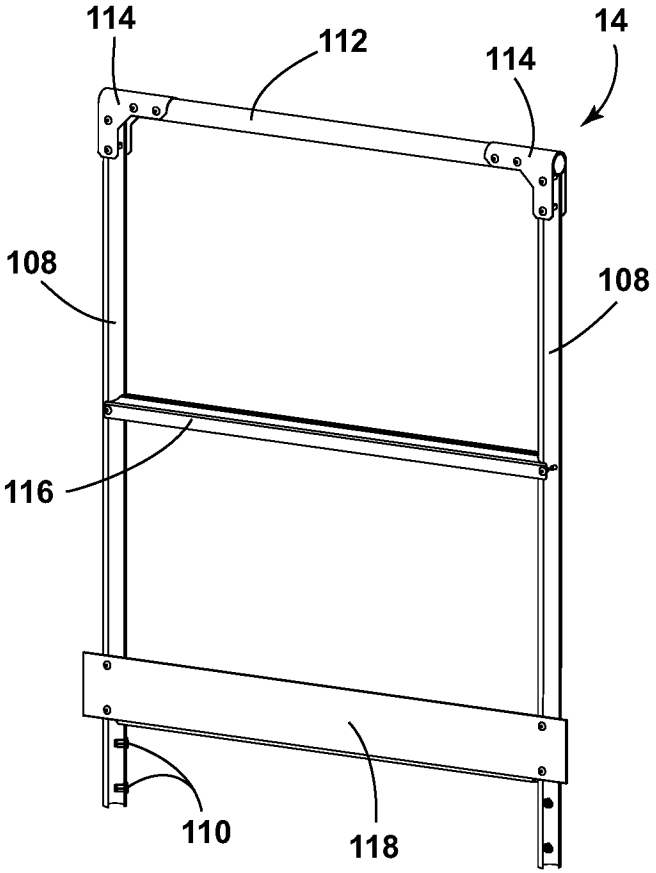

Guardrail Assembly 14/Connection Bracket 16. FIGS. 18-19 are isometric front (with portions of vertical members broken away) and rear views, respectively, of a multi-piece guardrail (GR) assembly 14, in an embodiment. Guardrail assembly 14 includes a pair of vertical posts 108 (left and right) each including a respective pair of threaded inserts 110 (e.g., rivet nuts—rivnuts), a horizontal, top bar 112, a plurality of connection brackets 114, a midrail 116, and a toe board 118. It should be understood that although a threaded insert 110 is described (along with a companion elongate threaded bolt), that the instant disclosure is not so limited. The connection of the vertical post 108 to the corner bracket 56 may be accomplished by any 2-part connection arrangement.

The vertical posts 108 and horizontal top bar 112 may comprise a durable material like a metal such as steel or aluminum, and may comprise alloy steel tubing, 1.5 inch O.D., 14 GA, in an embodiment.

Figure 20A:
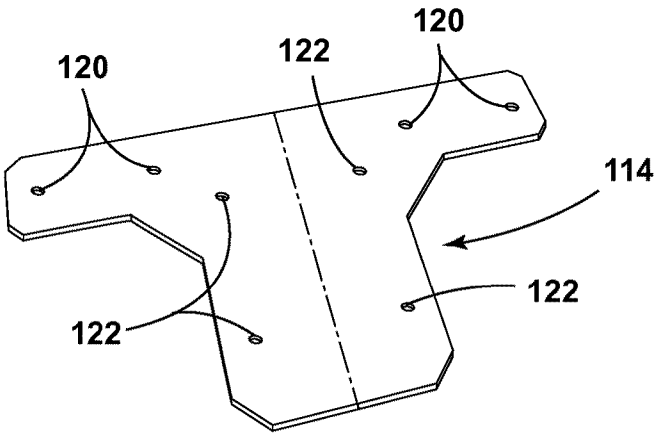
FIG. 20A is a top view of a flat pattern piece of material configured to be formed (by being bent) into a GR connection bracket that joins together vertical GR left and/or right GR posts and a horizontal GR top bar of the GR assembly, in an embodiment.

FIG. 20A is a top view of a flat pattern piece of material configured to be formed (by being bent) into a guardrail connection bracket 114 that joins together a vertical left and/or right guardrail posts 108 and a horizontal guardrail top bar 112, in an embodiment. Connection bracket 114 may be made of relatively thin metal which can be bent into the shape shown in FIG. 20B.

Figure 20C:
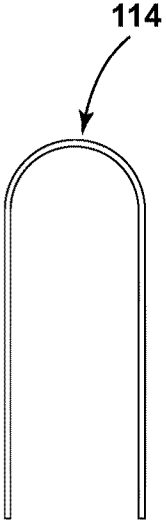
FIGS. 20B-20D are isometric, side, and front views of the GR connection bracket formed from the flat pattern of FIG. 20A.
Figure 20D:
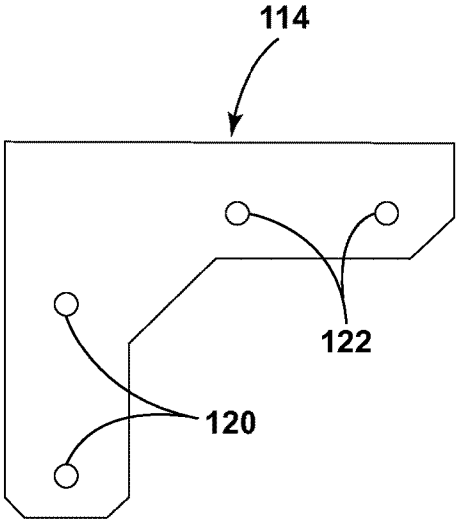
Figure 20B:
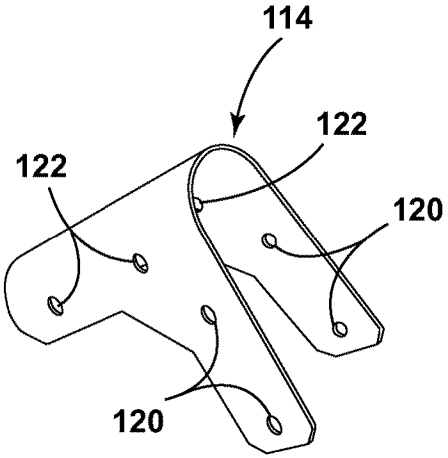

FIGS. 20B-20D are isometric, side, and front views of connection bracket 114 formed from the flat pattern of FIG. 20A. As shown in FIG. 20D, connection bracket 114 includes, a plurality of apertures per side, including a first pair of apertures 120 (vertical orientation) and a second pair of apertures 122 (horizontal orientation). Note that there are corresponding apertures aligned with those shown in FIG. 20D on the opposite side of the bracket, for a total of eight apertures 120, 122 (this is seen in the FIG. 20A flat pattern). The apertures 120 allow the connection bracket 114 to be coupled to a vertical member 108, for example, through the use of rivets or the like. The apertures 122 allow the connection bracket 114 to be coupled to the horizontal top bar 112, for example, through the use of rivets or the like.

Figure 21:
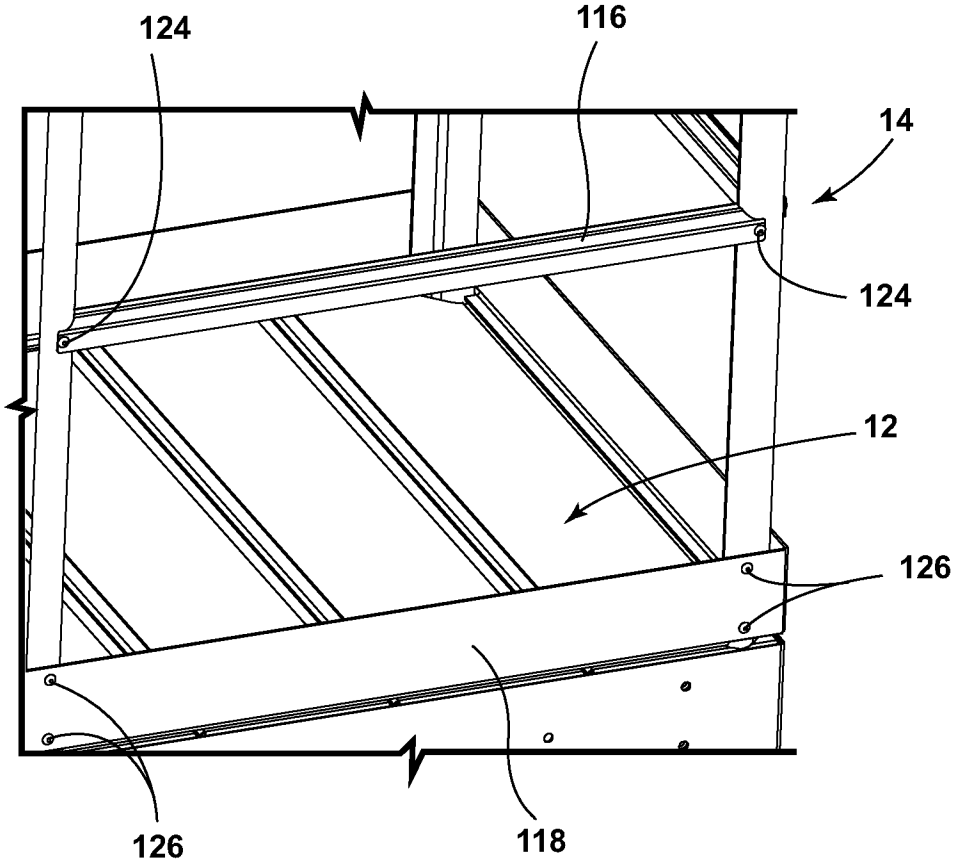
FIG. 21 is an isometric, enlarged view of a lower portion of the GR assembly of FIGS. 18-19 in relation to a platform, showing a GR midrail and a GR toe board, in greater detail.

FIG. 21 is an isometric, enlarged view of a lower portion of the guardrail assembly 14 of FIGS. 18-19 in relation to a platform. FIG. 21 shows guardrail midrail 116 and guardrail toe board 118 in greater detail. The midrail 116 may be connected to both vertical members 108 using fasteners such as rivets 124. The toe board 118 can be connected to both vertical members 108 using fasteners such as rivets 126.

Figure 22:
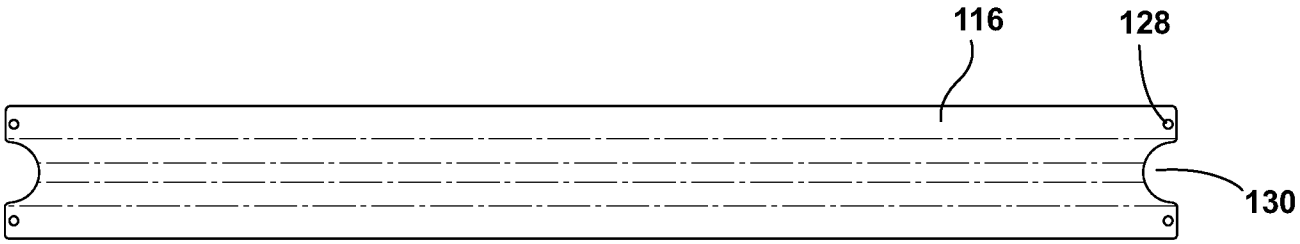
FIG. 22 is a top view of a flat pattern piece of material configured to form the GR midrail of FIG. 21 by bending along the designated bend lines (dashed).

FIG. 22 is a top view of a flat pattern piece of material configured to form the guardrail midrail 116, such as by bending along the designated four bend lines (dashed). The bends may be approximately forty-five degrees, as shown in the resulting cross-sectional profile as in FIG. 23A. The flat pattern may comprise a relatively durable and strong material, such as relatively thin metal, for example. The flat pattern also includes a plurality of apertures 128 to be used for connection between and to vertical members 108 as well as a semi-circular cutout 130 at both longitudinal ends, for accommodating the shape of the vertical members when installed in guardrail assembly 14.

Figure 23B:
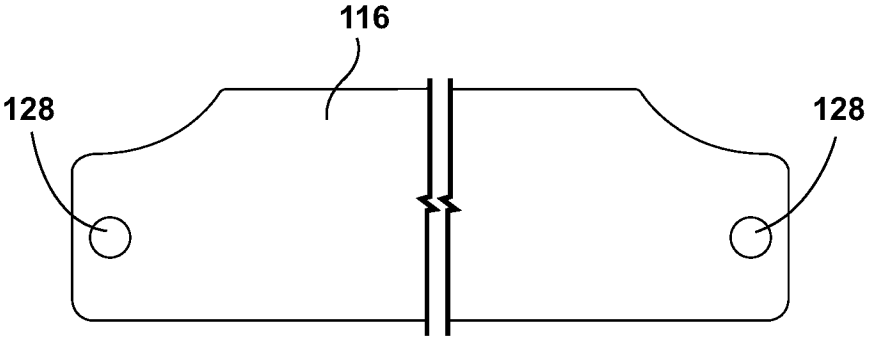
FIGS. 23A-23B are side and front views of the GR midrail of FIG. 21.
Figure 23A:
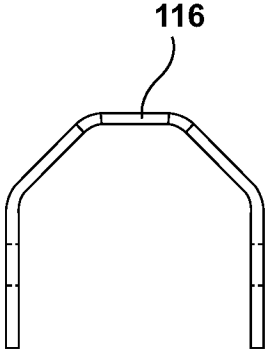

FIGS. 23A-23B are side and front views of the guardrail midrail 116, in a formed/final shape.

Figure 24:
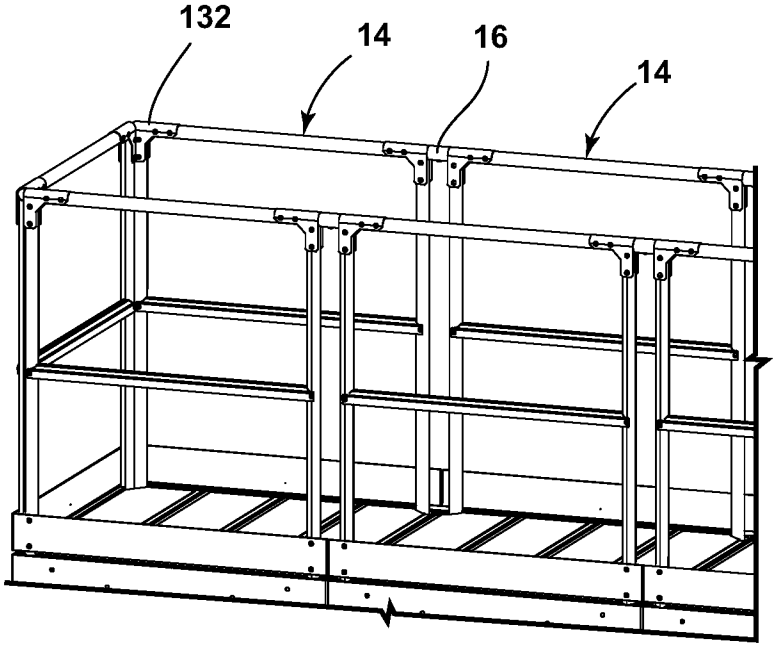
FIG. 24 is an isometric view of a plurality of multipiece GR assemblies, as connected together using a guardrail (GR) connector assembly for straight connections, in an embodiment.

FIG. 24 is an isometric view of multiple, separate guardrail assemblies 14 being connected together by way of multiple guardrail connector assemblies 16. The guardrail connector assembly 16 has an outside diameter (OD) that matches that of the top bar 112 such that a smooth, substantially continuous guardrail can be provided. FIG. 24 also shows a corner 132 where two guardrail assemblies 14 meet at about a ninety degree angle, that does not use the guardrail connector assembly 16 but instead may be butted next to each other (i.e., the two top ends are independent but do contact or abut each other).

Figure 25:
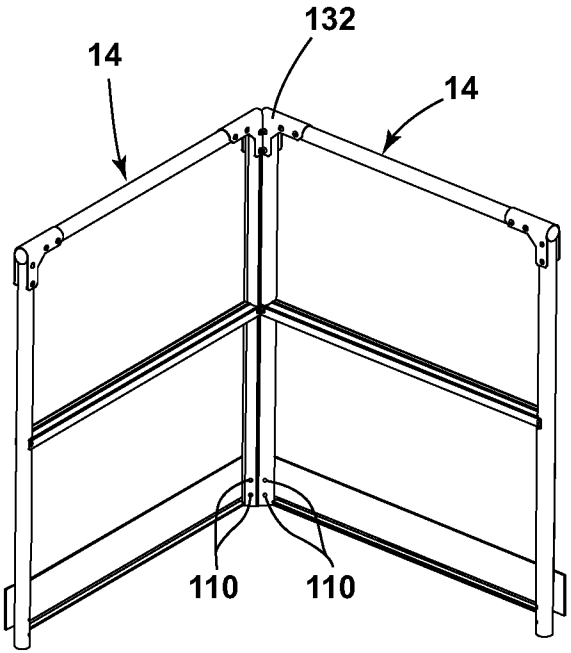
FIG. 25 is an isometric view of a pair of multi-piece GR assemblies in an abutting relation to form a substantially right angle corner.

FIG. 25 is an isometric view of two guardrail assemblies 14 forming a right angle corner 132 and further showing at the lower end a pair of threaded inserts 110 (e.g., rivnuts).

Figure 26:
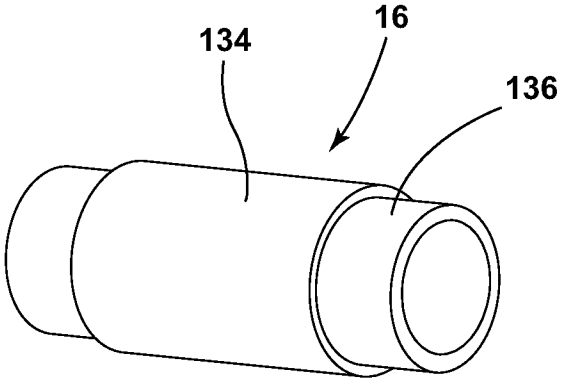
FIG. 26 is an isometric view showing, in greater detail, the GR connector assembly of FIG. 24, in an embodiment.

FIG. 26 is an isometric view showing, in greater detail, guardrail connector assembly 16, in an embodiment. The guardrail connector assembly 16 may include a first tube 134 having an outer or outside diameter (OD) substantially equal to the outside diameter (OD) of the horizontal top bar 112. This is selected so as to match that of the top bar to provide a substantially continuous guardrail when so connected by assembly 16. The guardrail connector assembly 16 may further include a second tube 136 having an outside diameter (OD) no larger than the inside diameter (ID) of the first tube 134. The first and second tubes 134, 136 are configured so as to prevent relative rotation therebetween, such as by use of a fastener (not shown in FIG. 26) such as a rivet or by other means know to one of ordinary skill in the art.

Figure 27:
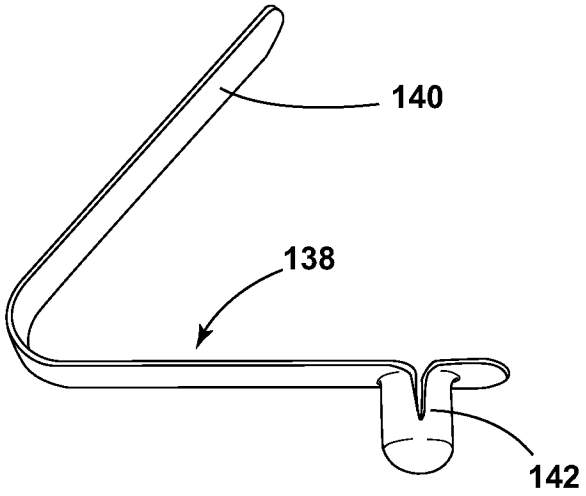
FIG. 27 is an isometric view of a spring clip used in the GR connector assembly of FIG. 26.

FIG. 27 is an isometric, side view of a spring clip 138 having an resilient (spring) portion 140 and a manually-actuatable press button 142 for purposes to be described below.

Figure 28:
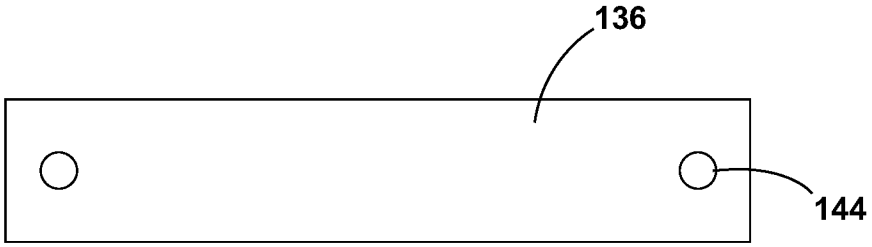
FIG. 28 is a bottom view of a second (inner) tube of the GR connector assembly of FIG. 26.

FIG. 28 is a bottom view of second tube 136 and which includes a pair of through-apertures such as holes 144 located generally at opposite longitudinal ends and sized so as to accommodate the distal end of the press button 142 so as to allow the button 142 to snugly pass therethrough.

Figure 29:
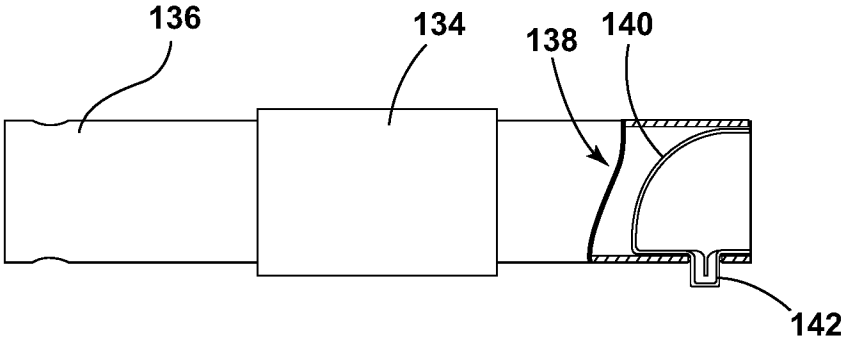
FIG. 29 is a side view, with portions partially broken away, of the GR connector assembly of FIG. 26, showing the spring clip of FIG. 27 installed with press button extending through an aperture.

FIG. 29 is a partially broken away side view of the connector assembly 16 showing the spring clip 138 inserted inside the inside diameter of the second tube 136. The spring clip 138 is configured in size and resilience so as to be insertable in the tube 136 such that the press button 142 is urged through the hole 144, thereby being retained inside the tube 136. Additionally, the distal end of the press button 142 extends farther out (i.e., radially outwardly) than the OD of the first tube 134. This sizing allows the distal end of the press button 142 to extend through a through-hole made in the horizontal top bar 112 (see FIG. 31).

Figure 30:
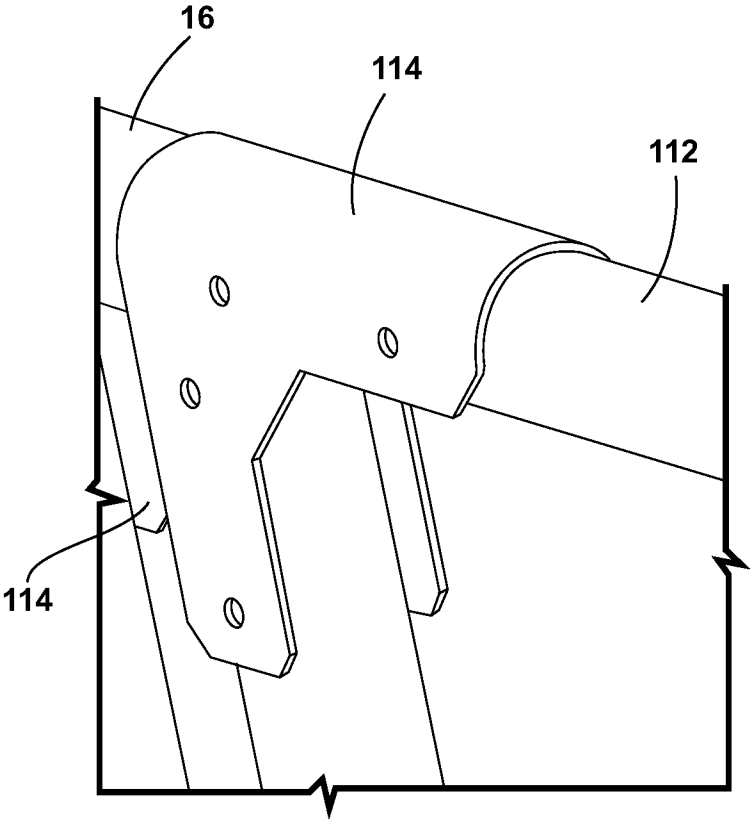
FIG. 30 is an isometric view of the GR connection bracket connecting the top GR bar with a GR post and the GR connector assembly connected to the top GR bar.

FIG. 30 is an isometric view of a guardrail connector assembly 16 inserted into a free end of a horizontal top bar 112. As shown, the OD of the connector assembly 16 is at substantially the same level as that of the horizontal top bar 112.

Figure 31:
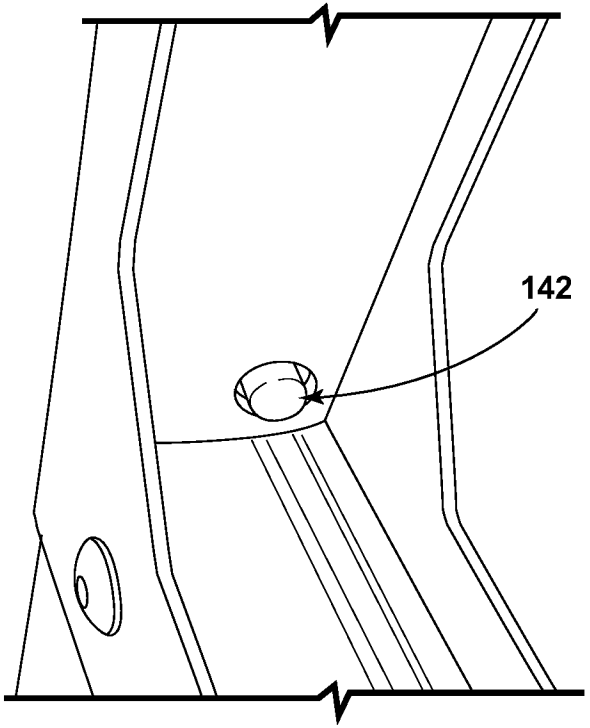
FIG. 31 is an isometric and enlarged view similar to what is illustrated in FIG. 29 but shown from the bottom and with the extended press button shown.

FIG. 31 is an isometric and enlarged view similar to what is illustrated in FIG. 30 but viewed from the bottom and showing the press button 142. The horizontal top bar 112 is formed with a through-hole and sized in diameter so as to allow the press button 78 to resiliently project through when the inner tube 136 of the connector assembly 16 is inserted far enough into the horizontal top bar 112 so that the press button 142 and the through-hole of the top bar 112 are aligned. When such alignment occurs, the resiliently-loaded press button 142 of the spring clip 138 projects through the through-hole of the horizontal top bar 112, thereby temporarily (i.e., removably) locking the guardrail connector assembly 16 in place relative to the horizontal top bar 112. This locking function is in the axial direction and also angularly/rotationally. The connector assembly 16 will therefore not slide axially out of and away from its locked position nor will rotate. To remove the connector assembly 16 from the horizontal top bar 112, a user fully depresses the press button 142 so that it no longer acts as a lock while at the same time pulling on the guardrail connector assembly 16 to remove it.

Figure 32:
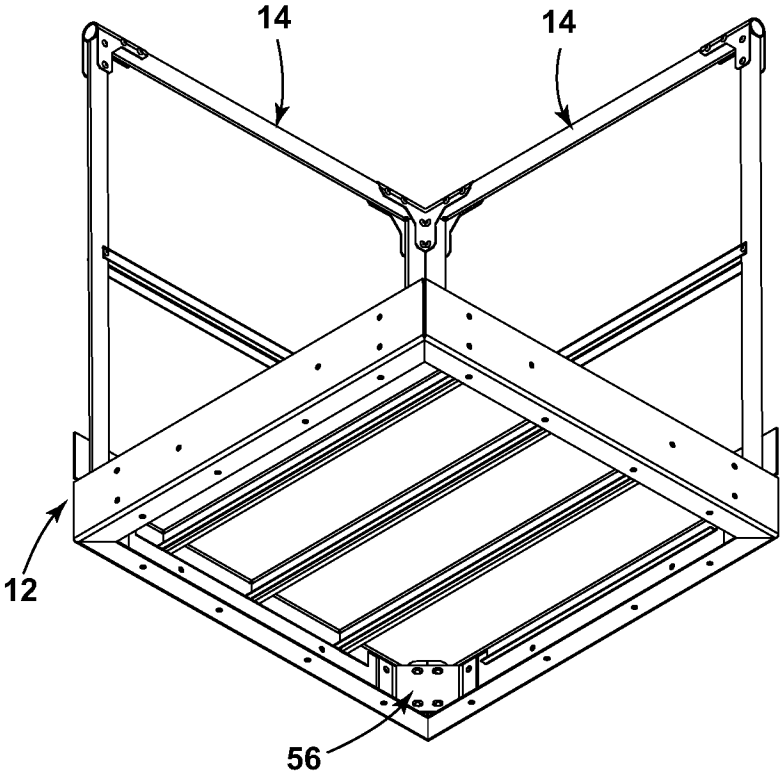
FIG. 32 is an isometric view of a platform as seen from the bottom showing a guardrail assembly-to-platform connection, in an embodiment.

Guardrail 14-To-Platform 12 Connections. FIG. 32 is an isometric view of platform 12 as seen from the bottom showing the platform corner bracket 56. A description of how the guardrail vertical posts 108 connect to the corner bracket 56 will now be set forth.

Figure 33:
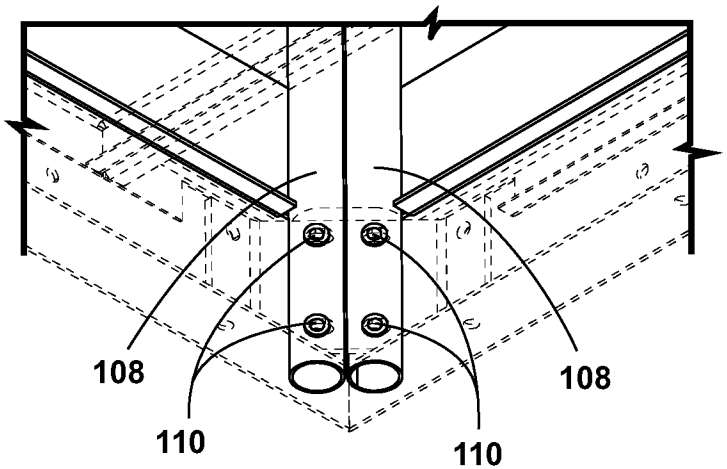
FIG. 33 is an isometric, enlarged view of FIG. 32, with portions broken away, showing how GR posts are inserted and can be secured to the corner bracket as shown in FIG. 9.

FIG. 33 is an isometric, enlarged view of FIG. 32, with portions broken away, showing how the guardrail vertical posts 108 are situated relative to the corner bracket 56. In particular, FIG. 33 shows the threaded inserts 110 are aligned with and are thus in registry with the slots 64 of the corner bracket 56. The inside surface of lip 46 provide a mechanical stop for the lower, distal ends of the vertical posts 108 when inserted through the cutouts 34. Thus, the threaded inserts 110 and the bracket slots 64 are aligned. This alignment allows insertion of an elongate threaded bolt or the like through the slots 64 and into the threaded inserts so as to mechanically connect the vertical posts 108 to the corner bracket 56.

Figure 34:
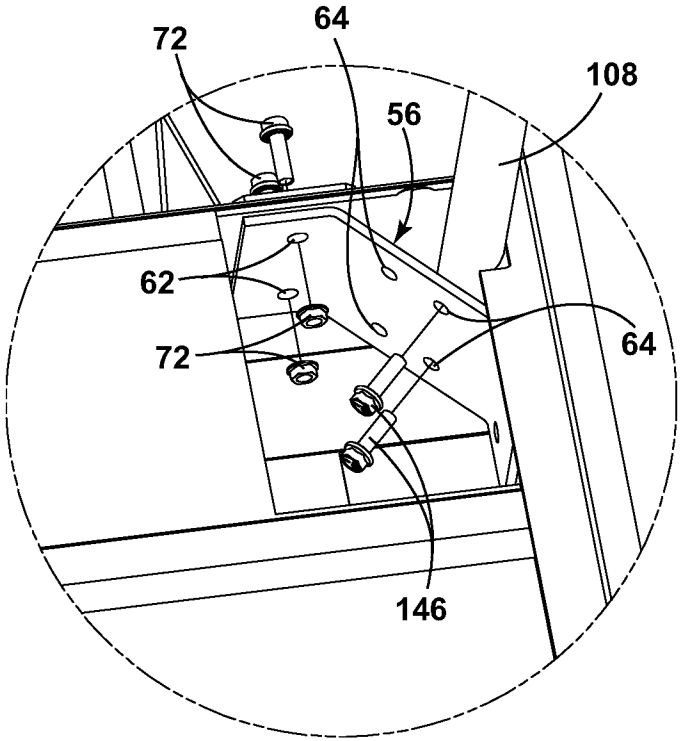
FIG. 34 is an isometric, enlarged view of a platform as seen from the top, with portions broken away and partially exploded (fasteners), to show how a GR post can be inserted and secured.

FIG. 34 is an isometric, enlarged view of platform 12 as seen from the top, with portions of the tread surface broken and partially exploded (fasteners) to show how a guardrail vertical post 108 can be inserted and secured to the corner bracket 56/platform 12. A vertical post 108 of a guardrail assembly 14 is inserted through the cutout 34 and into the cavity 68 (FIG. 9) until the lower, distal end of post 108 engages lip 46, at which point the threaded inserts 110 of the post 108 align with slots 64 of the corner bracket 56. Elongate fasteners such as threaded bolts 146 are inserted through slots 64 and thereafter installed, thereby securing the vertical post 108—and thus the guardrail assembly 14—to the corner bracket 56 of the platform 12. In the particular illustration of FIG. 34, the cavity 68 further includes an unoccupied space for a further vertical post 108 that can be secured to the corner bracket 56. FIG. 34 also shows fasteners 72 connecting the subject platform 12 to an adjacent platform 12, although it should be understood that an alternate component of the modular access system 10 could be so connected through the same holes 62, such as stile assembly 24 or fixed ladder 17.

Figure 35:
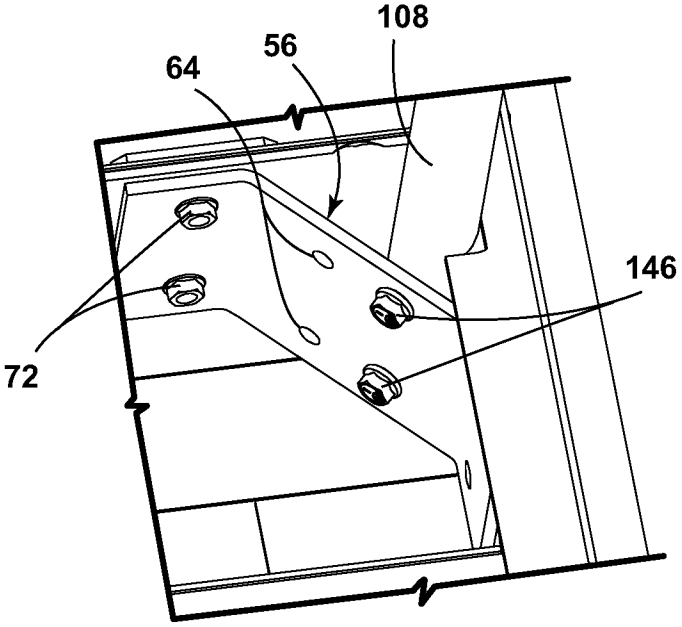
FIG. 35 is an isometric view showing the platform of FIG. 34 with a GR assembly after fasteners have been installed.

FIG. 35 is an isometric view showing the platform of FIG. 34 with the guardrail vertical post 108 after the fasteners 146 have been installed. The fasteners 72 have also been secured.

Figure 36:
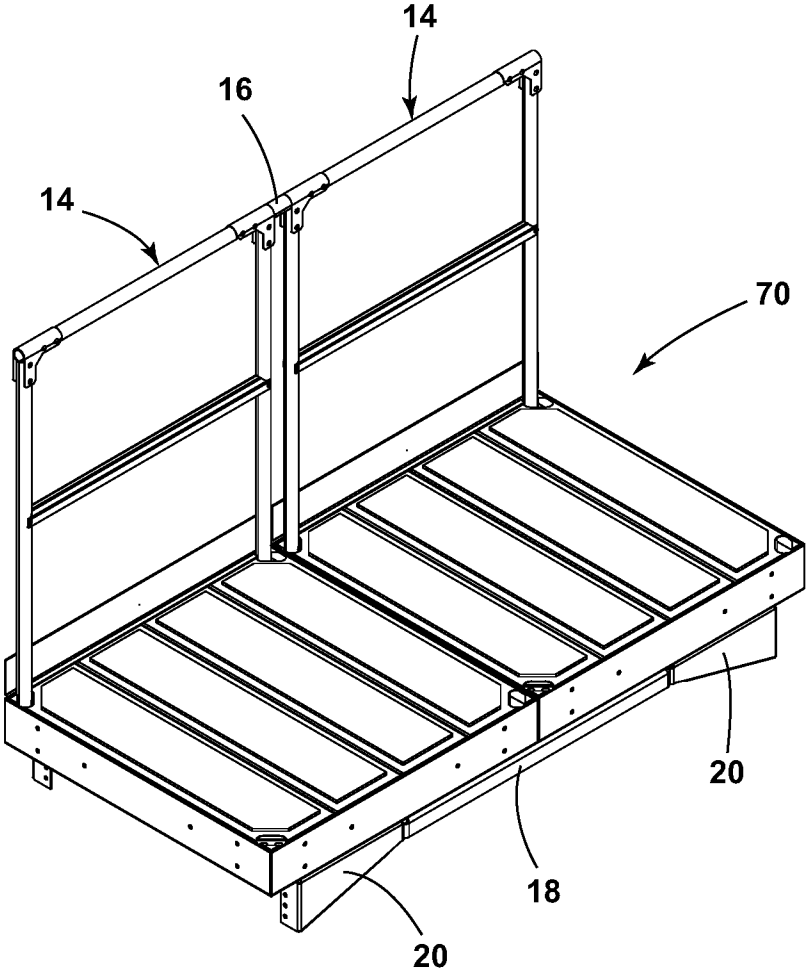
FIG. 36 is an isometric view showing a platform assembly including first and second platforms with exemplary GR assemblies installed thereto.

FIG. 36 is an isometric view showing a platform assembly 70 including first and second platforms 12 with exemplary guardrail assemblies connected thereto and to each other. FIG. 36 further shows that the platform assembly 70 has support angle 18 installed as well as gussets 20.

Figure 38:
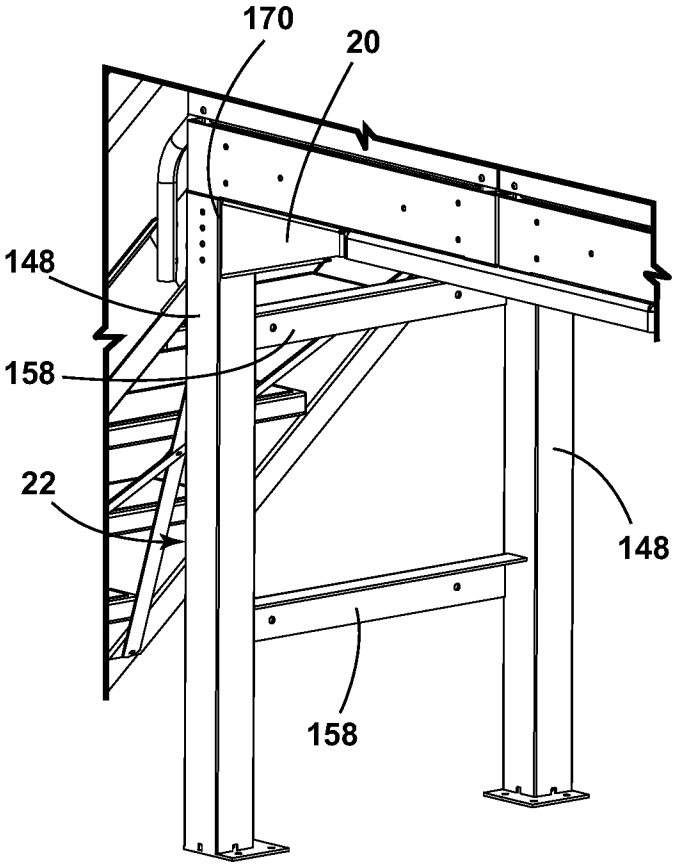
FIG. 38 is an isometric view showing the platform support (gusset) connected to a vertical member of the tower of FIG. 37.
Figure 39:
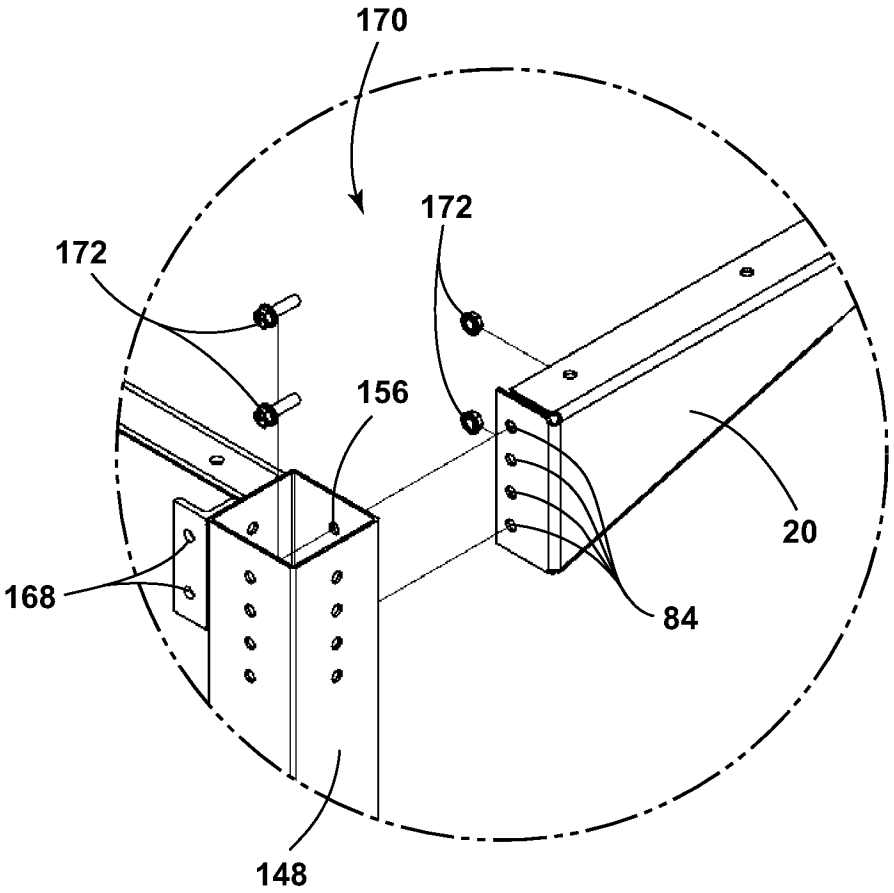
FIG. 39 is an isometric, partially exploded view of the gusset-to-tower connection of FIG. 38 is greater detail.

Towers 22. FIGS. 38-39 are isometric views of an embodiment of tower 22. The tower 22 is configured to support and elevate the platforms 12 above the ground at a desired height. Tower 22 includes a pair of vertical members 148 each including at a lowermost end thereof a respective foot 150. Each foot 150 includes mounting apertures 152 (three—only two apertures shown in the FIGS.) suitable to receive elongate fasteners (not shown) therethrough for securing the tower 22 and thus the modular access system 10 to an underlying structure, thereby improving stability. An upper-most end 154 of tower 22 includes a plurality of vertically arranged through apertures 156 suitable for receiving elongate fasteners (not shown) for securing gusset 20 thereto. The vertical members 148 in the illustrated embodiment are generally square-shaped in cross-section (i.e., four sides) and in this regard, apertures 156 are disposed in each of the four sides at the upper end 154. In an embodiment, the vertical members 148 may comprise four inch by four inch, 11 GA square tubing, having a predetermined desired height at which the platforms will be elevated (e.g., about fifty-four inches in an embodiment). It should be understood this is exemplary only and not limiting in nature.

The tower 22 further includes horizontal members 158 each of which include a pair of spaced-apart through apertures 160, which can be used to connect additional components of the modular access system, for example only, a fixed ladder such as fixed ladder 17 shown in FIG. 3 may be used to connect the fixed ladder (e.g., mounting brackets thereof) to the tower 22. In an embodiment, the horizontal members 158 may each comprise a steel angle member having a pair of legs defining a generally L-shaped structure in cross-section, and may be approximately thirty inches in length. The horizontal members 158 may be secured to the vertical members 148 via conventional approaches such as by welding.

The tower 22 further includes a horizontal top bracket 162, which may also be formed using a steel angle member having a pair of legs defining a generally L-shaped structure in cross-section and may be approximately thirty inches in length. The horizontal top bracket 162 may be secured to the vertical members 148 via conventional approaches such as by welding. In the illustrated embodiment, the horizontal leg of the top bracket is substantially flush with the top end of the vertical members 148. Top bracket 162 also includes a plurality of through apertures 164—four apertures 164 are shown. The apertures 164 are configured in size and spacing to align with apertures 54 of the bottom lip 46 of platform 12. Using elongate fasteners such as threaded bolts and cooperating nuts inserted through such aligned apertures, the tower 22 can be removably connected to the bottom of platform 12.

Tower 22 further includes a pair of brackets 166 respectively connected to the vertical members 148. Bracket 166 as shown may comprise an angle having a pair of legs forming a generally L-shaped structure. Bracket 166 comprises a metal such as steel or aluminum, and in an embodiment comprises steel. The brackets 166 may be connected to each of the vertical members 148 (e.g., via welding). The top of bracket 166 is substantially flush with the top of the vertical member 148. Each bracket 166 includes a pair of through apertures 168 to allow the connection of additional components to the modular access system 10 when the tower 22 is installed, for example, this can be a stile assembly 24.

Figure 37:
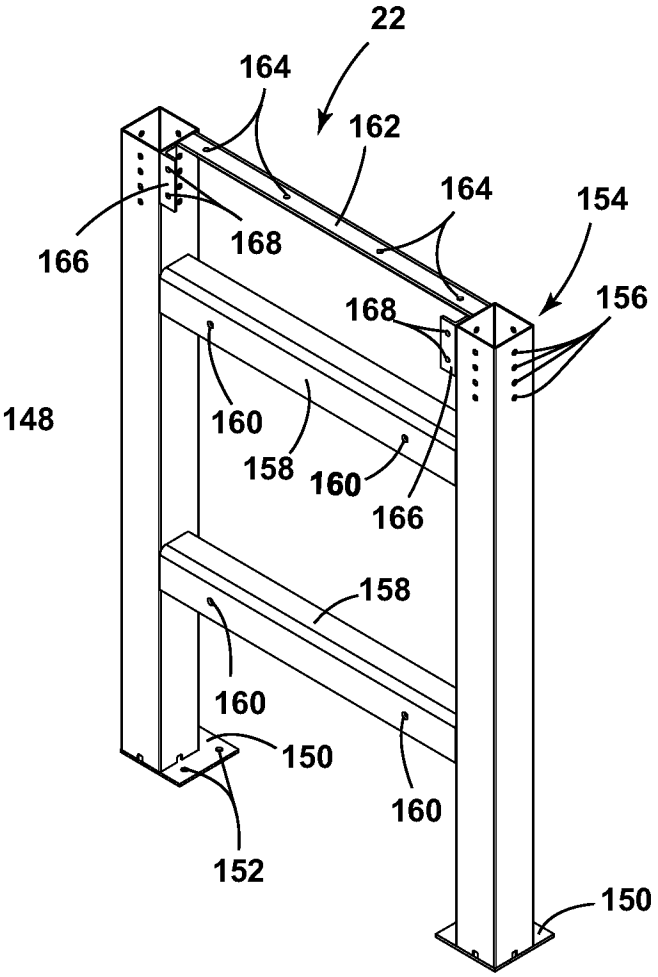
FIG. 37 is an isometric view of a tower configured to elevate a platform and/or platform assembly relative to the ground or floor.

FIG. 38 is an isometric view of tower 22 as seen from an opposite side relative to that shown in FIG. 37, and shows a connection interface 170 between gusset 20 and tower vertical member 148.

Platform Assembly-To-Tower Connections. FIG. 39 is an isometric, partially exploded view of the gusset-to-tower connection 170 as seen in FIG. 38. Apertures 84 of gusset 20 align with apertures 156 in vertical member 148 of tower 22 (only one of the apertures 156 used for this connection are visible in FIG. 39). Elongate fasteners 172 such as threaded bolts and cooperating nuts may be used. Such bolts are inserted through the aligned holes 84, 156 and secured using the cooperating nuts. This connection approach would be used for other similar gusset/tower/platform connections.

Figure 40:
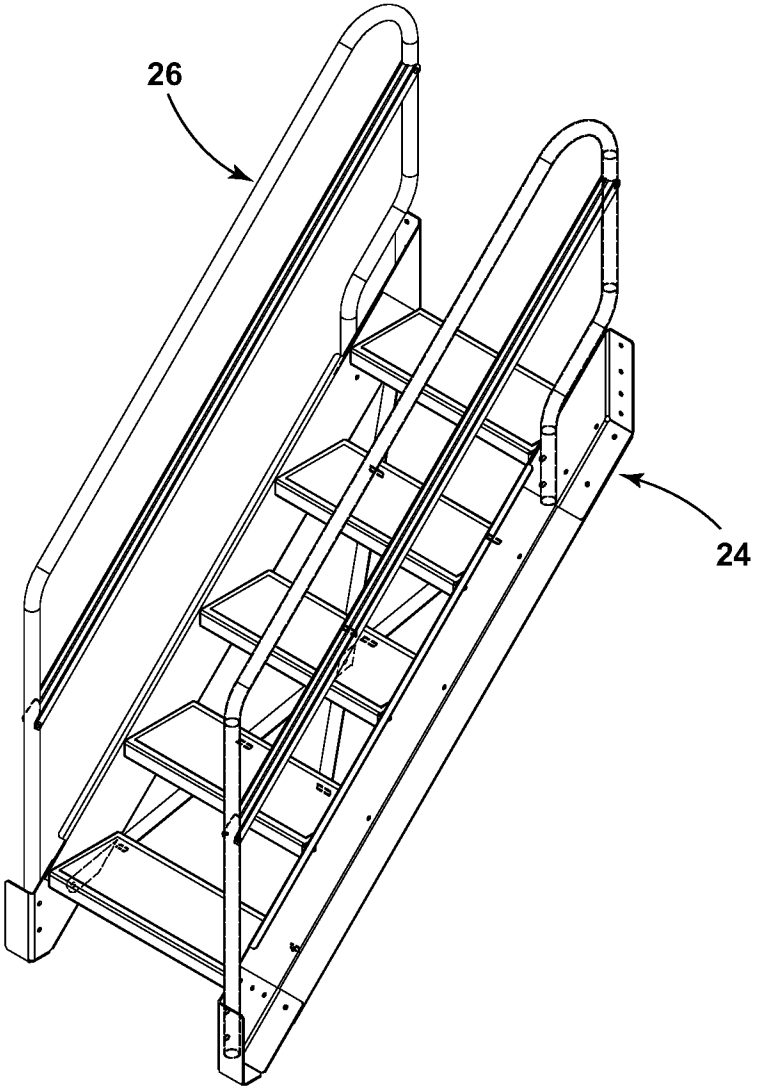
FIG. 40 is an isometric view of the stile assembly and handrail assembly of FIG. 1.

Stile Assembly 24/Handrail Assembly 26. FIG. 40 is an isometric view of stile assembly 24, which includes five treads or steps and is considered a 6-step embodiment when mounted to platform 12, although it should be understood that other embodiments such as variations as to the number of steps and the rise height are possible. Handrail assembly 26 is shown attached to stile assembly 24.

Figures 41A, 41B:
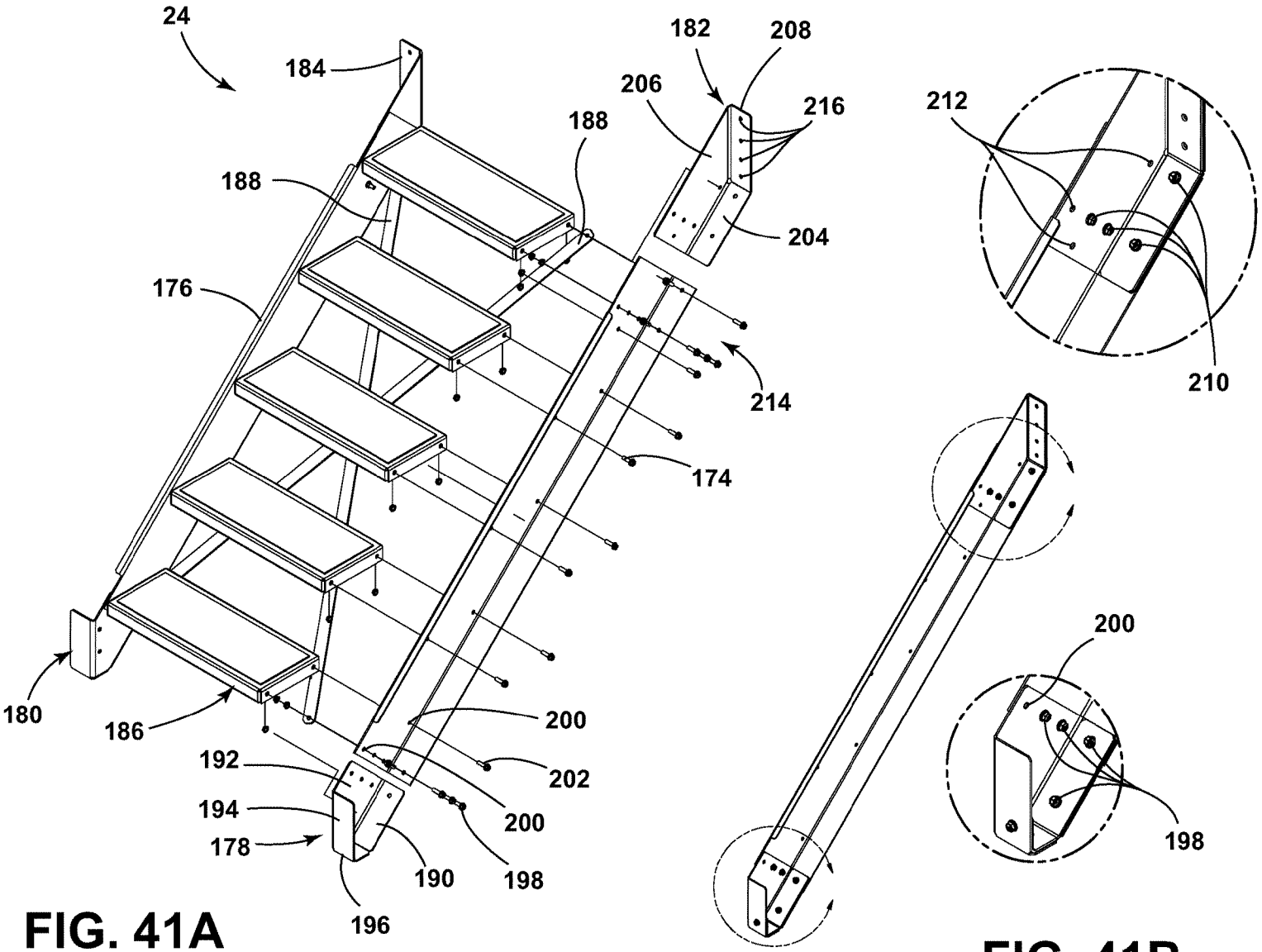
FIG. 41A is an isometric, partially exploded view of the stile assembly of FIG. 40.
FIG. 41B is an isometric, enlarged view of a stile board and top and bottom stile brackets of FIG. 41A.

Stile Assembly 24. FIG. 41A is an isometric, partially exploded view of stile assembly 24. Stile assembly 24 includes right and left stile boards 174, 176, which are configured to provide a tread or step support function, a bottom right hand (RH) stile bracket 178, a bottom left hand (LH) stile bracket 180, a top RH stile bracket 182, a top LH stile bracket 184, a plurality of stile treads 186, an a pair of bracing elements 188. The right side is exploded for purposes of detailed description and it should be understood that such description applies to the left side with suitable adaptations for left side versus right side changes. The right stile board 174 in an embodiment is a single piece component made from metal such as steel or aluminum, and may be steel.

Bottom right hand bracket 178 includes an L-shaped portion having legs 190 and 192, a vertical portion 194, and a foot portion 196. Legs 190, 192 include a number of through apertures 198—two apertures 198 on leg 190 and four apertures 198 on leg 192. The stile board 174 also includes apertures that align with some of the apertures 198 as described below.

FIG. 41B is an isometric, enlarged view of the bottom and top portions of stile board 174. The bottom apertures 198 on leg 192 align with holes in the stile board and allow insertion of elongate fasteners to connect the bottom stile bracket 178 to the stile board 174. The uppermost aperture 198 on leg 190 aligns with an aperture on the stile board and can also accept an elongate fastener connecting bracket 178 to stile board 174. An uppermost aperture 200 on bracket 178 also aligns with aperture 200 on the stile board 174 but additionally is used to connect tread 186 to the stile board. The stile board 174 shows two apertures 200 per tread 186. Foot 196 also includes a through hole (not visible) to allow the stile assembly 24 to be connected to an underlying structure using an elongate fastener, if desired.

Referring again to FIG. 41A, top right stile bracket 182 includes an L-shaped portion having legs 204, 206 and a generally vertically oriented flange 216 that includes a plurality of through apertures 216, via which the stile assembly 24 may be connected to the platform of the modular access system 10. As shown in FIG. 41B, top right stile bracket 182 includes five apertures that align with corresponding apertures in stile board 174. Four of the five apertures, designated apertures 210, are used to connect the bracket 182 to the stile board 174 only, while one of the apertures designated 212 constitute aligned bracket and stile board holes but additionally are aligned with a hole in the side flange of tread 186. The topmost aperture 212 is also used for connecting the tread 186 to the stile board 174.

Figures 42A, 42B, 42C:
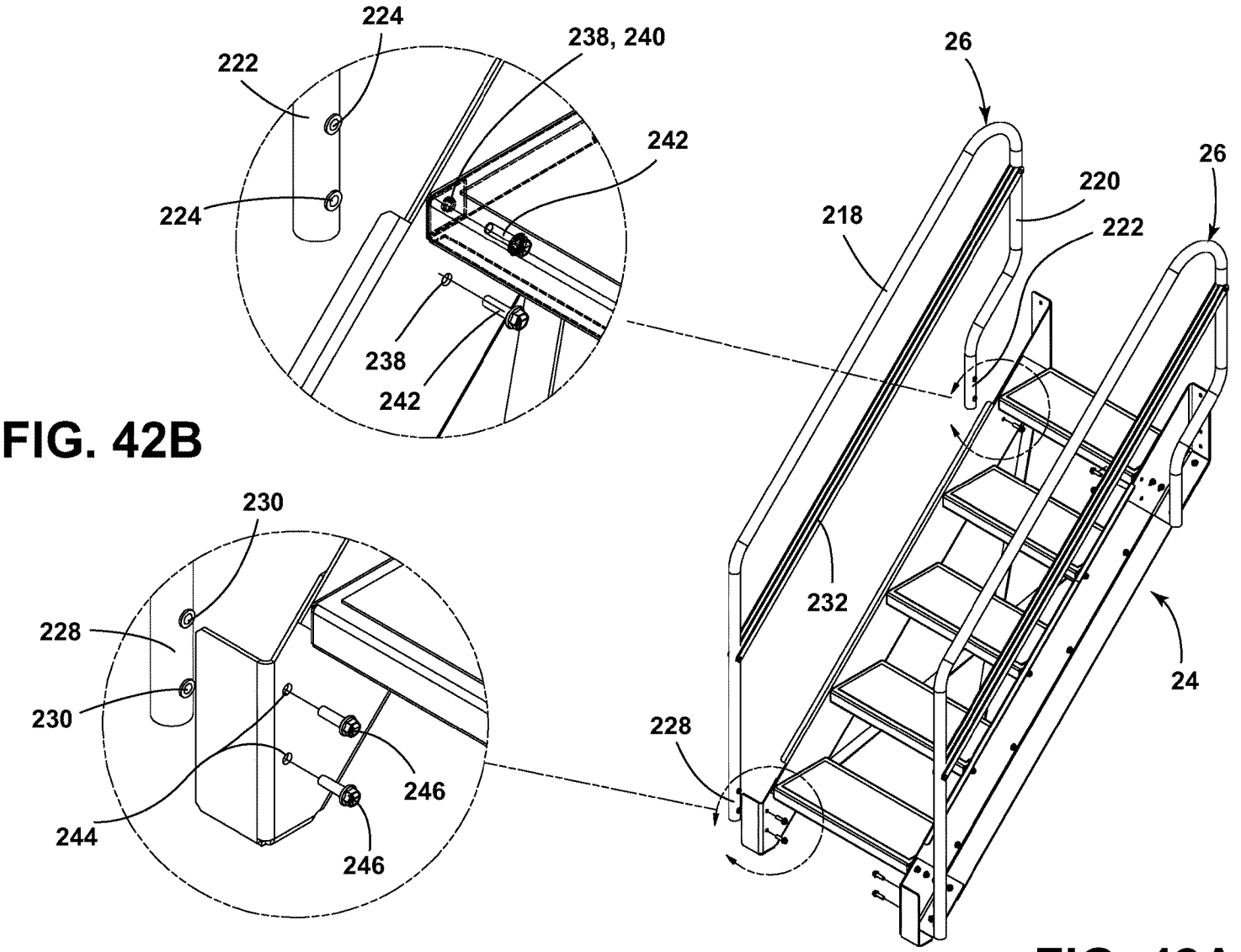
FIG. 42A is an isometric, partially exploded view of the stile and handrail assembly of FIG. 40.
FIG. 42B is an enlarged, partially exploded view of connection details of the top portion of the handrail assembly (left) and the stile assembly of FIG. 42A.
FIG. 42C is an enlarged, partially exploded view of connection details of the bottom portion of the handrail assembly (left) and the stile assembly of FIG. 42A.

Handrail Assembly-To-Stile Assembly Connection. FIG. 42A is an isometric, partially exploded view of the stile assembly 24 and handrail assembly 26 of FIG. 40 (i.e., left side handrail unassembled). The handrail assembly 26 includes an upper bar 218 suitable for a user to grasp when ascending or descending the stile assembly 24. The upper bar 218 extends into a top-side vertical portion 220 and further extends to a top-side mounting portion 222 (i.e., lowermost end) having threaded inserts 224 (e.g., rivet nuts—rivnuts) installed in the mounting portion 222 (see FIG. 42B for an enlarged view). The upper bar 218 also extends into a bottom-side vertical portion 226 and further extending into a bottom-side mounting portion 228 having threaded inserts 230 (e.g., rivet nuts—rivnuts) installed in the mounting portion 228. The handrail assembly 26 further includes a midrail 232, which may be formed in fashion similar to that of the guardrail midrail. The right side handrail of handrail assembly 26 will be the opposite having regard for left side versus right side adaptations.

FIG. 42B is an enlarged, partially exploded view of the connection details of the top-side portion of the handrail assembly 26 (left side) to the stile assembly 26. As shown, the threaded inserts 224 are aligned with apertures 238 in the left stile board (i.e., similar to right stile board 174). Additionally, the top-side aperture 238 may be further aligned with an aperture 240 associated with a tread 186. Elongate threaded fasteners 242 are then installed to thereby secure the top-side end of the handrail assembly 26 (left side) to the stile assembly 24.

FIG. 42C is an enlarged, partially exploded view of the connection details of the bottom-side portion of the handrail assembly 26 (left side) and the stile assembly 26. As shown, the threaded inserts 230 are aligned with apertures 244 in the left stile board (i.e., similar to right stile board 174). Elongate threaded fasteners 246 are then installed to thereby secure the bottom-side end of the handrail assembly 26 (left side) to the stile assembly 24. It should be understood that although threaded inserts 224/230 are described along with companion elongate threaded bolts, that the instant disclosure is not so limited. The connection of the handrail assembly 26 to the stile board may be accomplished by other connection approaches (e.g., riveting or welding may be contemplated as options).

Figure 43:
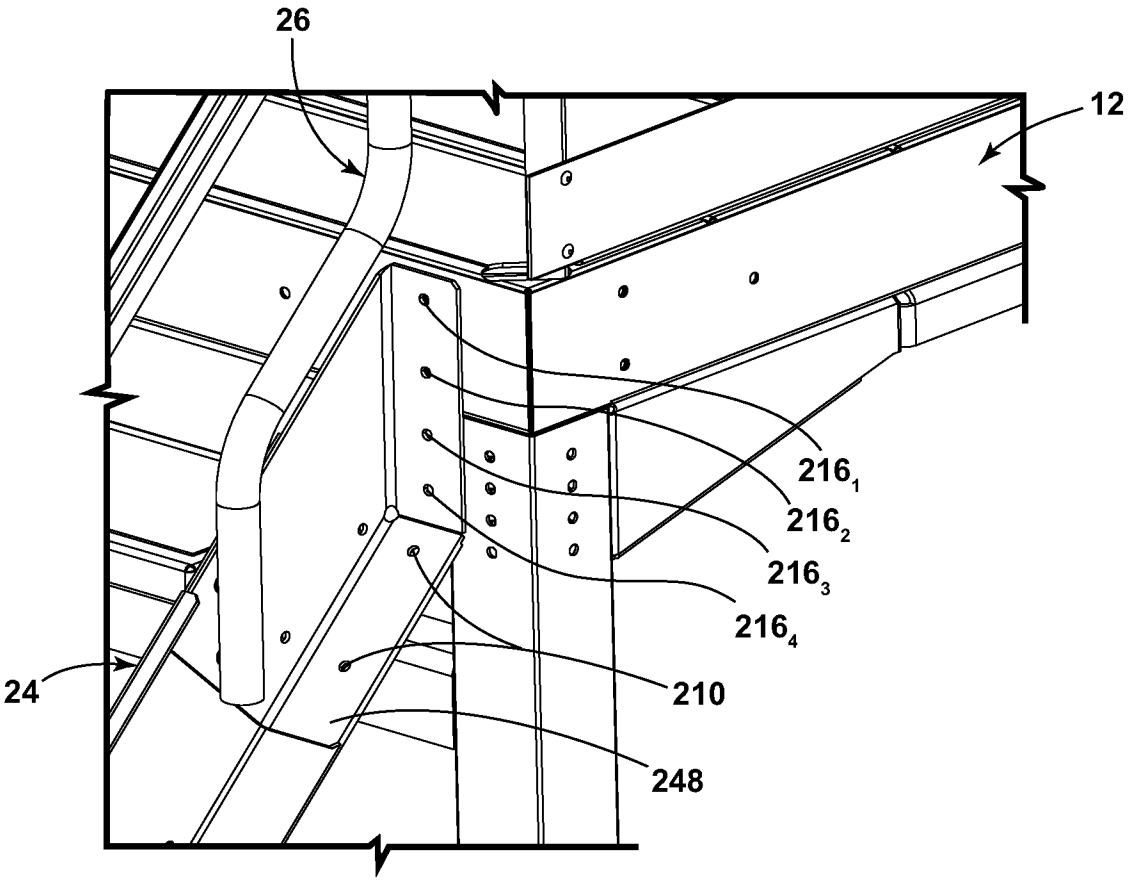
FIG. 43 is an isometric view showing the connection details between the top portion of the stile assembly of FIG. 40 and an elevated platform assembly.

Stile Assembly-To-Platform Connection. FIG. 43 is an isometric view showing the connection details between the top-side portion of stile assembly 26 and an elevated platform assembly. As shown, an optional reinforcement element 248 having an aperture layout respecting size and location that matches that of the top stile bracket and provides additional material thickness to the connection for increased strength. The upper two apertures designated $\mathbf{216}_1$ and $\mathbf{216}_2$ are aligned with the holes 50 in the platform side member 40 (see FIG. 6). The bottom two apertures $\mathbf{216}_3$ and $\mathbf{216}_4$ are aligned with bracket holes 168 (shown in FIGS. 37 and 39). Elongate fasteners (not shown, but may comprise threaded bolts and cooperating nuts) are inserted through apertures $\mathbf{216}_1$, $\mathbf{216}_2$, $\mathbf{216}_3$, and $\mathbf{216}_4$ and are secured on their distal ends using cooperating nuts. Apertures 210 of the reinforcement element 248 align with those of the stile bracket and therefore, insertion of the elongate fasteners as described in connection with FIGS. 41A-41B may be followed in the same fashion to secure the reinforcement element.

Figure 44A:
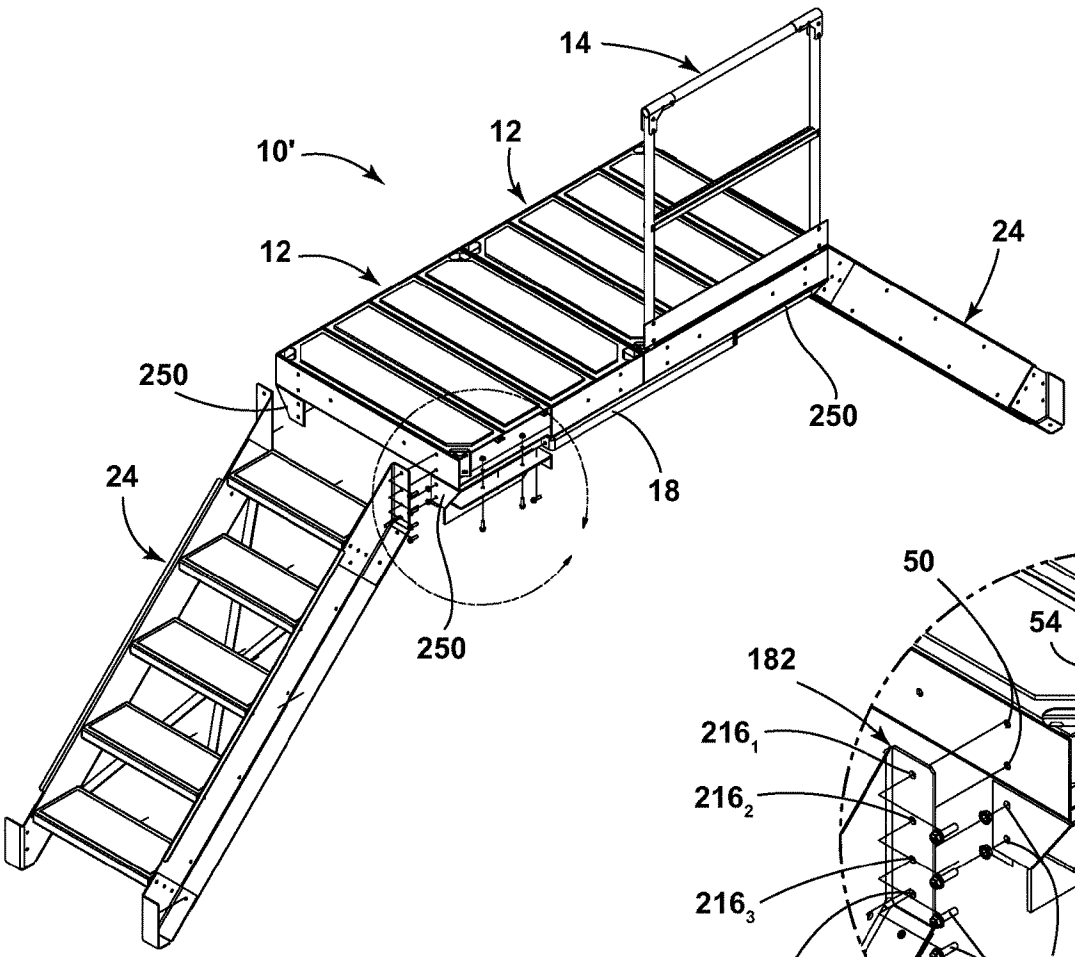
FIG. 44A is an isometric view showing a towerless modular access system according to a further embodiment.

Towerless Modular Access System. FIG. 44A is an isometric view showing a towerless modular access system 10' according to a further embodiment. The system 10' is similar to the modular access system 10 except that it does not utilize a tower 22 at each end for support of the main span of the platforms 12. This embodiment may be useful in environments where the nature of the obstacles to crossover are such that the use of a tower 22 to elevate the platforms may not be possible or desirable. Differences between modular access system 10 and modular access system 10' includes (i) the gusset 20 of system 10 is replaced with gusset 250 for system 10'; and (ii) a stile assembly 24 is used at both longitudinal ends of the platform assembly 70. The guardrail 14 has been omitted in FIG. 44A for clarity but should be understood that may be used in any particular implementation, along with other components described herein. With this background, the description of system 10' will begin with a description of gusset 250 and its connections.

Figure 44B:
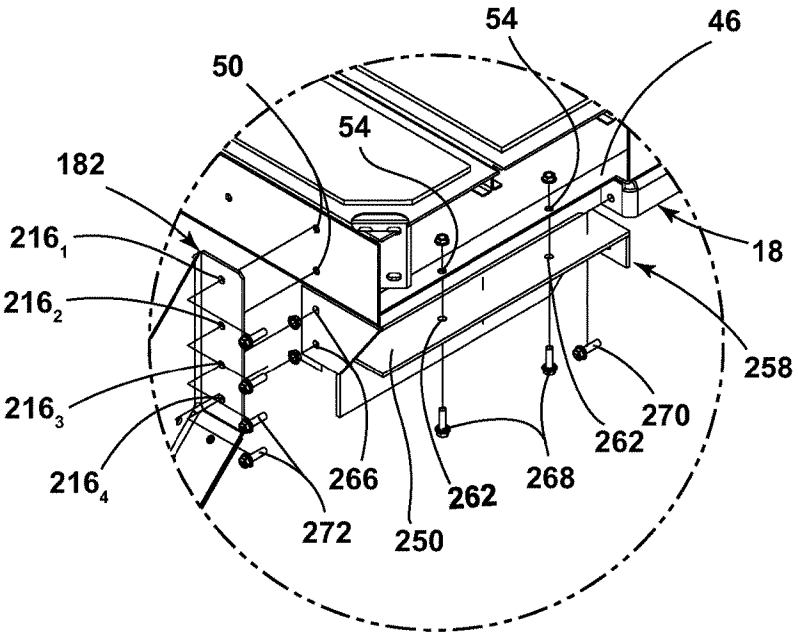
FIG. 44B is an isometric, enlarged view showing connection details between a stile assembly and a further embodiment of a platform support (gusset) according to the instant disclosure.

FIG. 44B is an isometric, enlarged view showing connection details between stile assembly 24 and a gusset 250, in an embodiment. Before setting forth a description of the connection, reference will be made to FIG. 45 and FIGS. 46A-46B for details of gusset 250. It should be understood that FIGS. 44A-B are partially exploded views and therefore portions thereof, including in particular gusset 250, are shown as separate pieces (e.g., gusset back 260) although in final form such pieces are in fact connected (e.g., in FIG. 46B, gusset back 260 is connected to gusset body 252).

Figure 45:
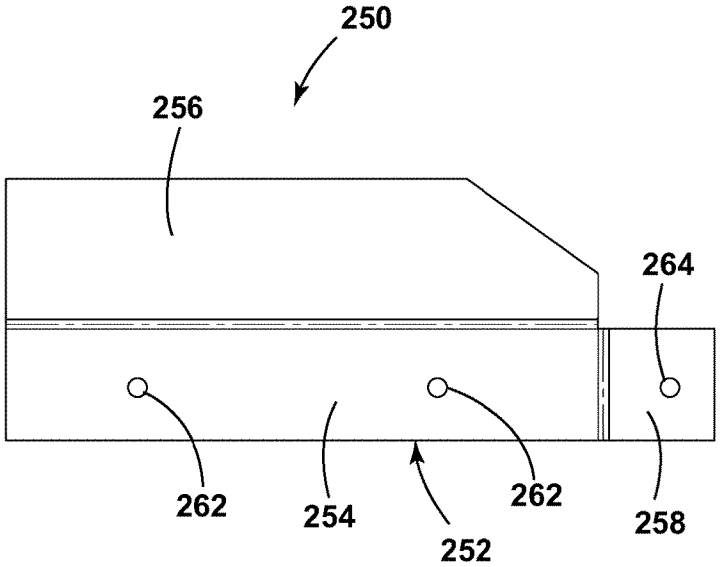
FIG. 45 is a top view of a flat pattern piece of material configured to form the platform support (gusset) according to the second embodiment in a towerless modular access system.

FIG. 45 is a top view of a flat pattern piece of material configured to form the gusset 250 according to an embodiment of system 10' after being bent/folded along the designated bend lines.

Figure 46A:
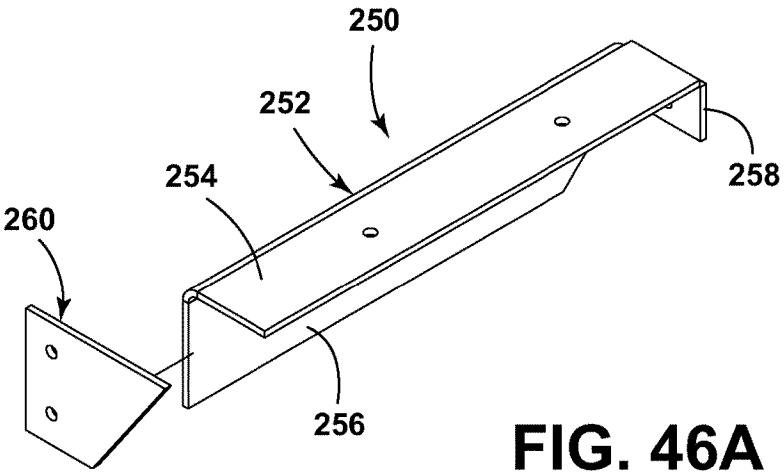
FIG. 46A is an isometric view of the platform support (gusset) of FIG. 44A-44B, before final assembly of its two component parts.
Figure 46B:
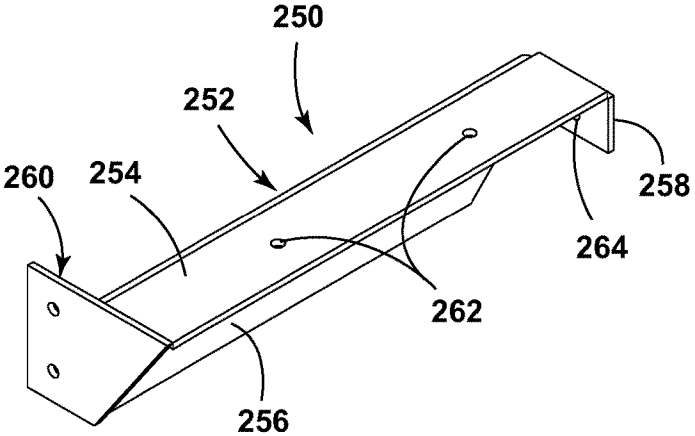
FIG. 46B is an isometric view of the platform support (gusset) of FIG. 46A as assembled.

FIG. 46A is an isometric, exploded view of gusset 250 while FIG. 46B shows gusset 250 in final form. Gusset 250, before final assembly, includes two component parts—a gusset body 252 and a gusset back 260. The gusset body 252 is a generally L-shaped angle element having legs 254 and 256, and in an embodiment such legs form a right angle. Leg 254 extends into a flange 258. Leg 254 includes a pair of through-holes 262, flange 258 includes a through-hole 264, and gusset back 260 includes a pair of through-holes 266. In an embodiment, gusset 250 is formed of a metal, such as aluminum or steel, and in one embodiment comprises steel. Gusset back 260 may be attached to gusset body 252 using conventional methods (e.g., welding).

With reference to FIG. 44B, gusset 250 is attached to lip 46 by aligning holes 262 of gusset 250 with holes 54 of lip 46. Elongate fasteners, such as threaded bolts 268, are then inserted through the aligned holes and secured using cooperating nuts. The gusset 250 is also attached to the adjacent support angle 18. In this regard, hole 264 of flange 258 is aligned with the hole 78 of the adjacent support angle 18 (see FIG. 14), and an elongate fastener, such as a threaded bolt 270 is inserted through the aligned holes and secured using a cooperating nut.

The stile assembly 24 is connected to the towerless modular access system 10' as follows. The uppermost two apertures of the top stile bracket 182, designated $\mathbf{216}_1$ and $\mathbf{216}_2$, are aligned with holes 50 of the platform 12 and the lowermost two apertures of the top stile bracket 182 are aligned with the holes 266 of gusset 250. Elongate fasteners 272, which may comprise threaded bolts 272 are inserted in through all four aligned holes $\mathbf{216}_1$-$\mathbf{216}_4$ and are secured using cooperating nuts. This process is repeated for both sides of both and/or each stile assembly 26 included in the modular access system 10'.

Although only certain embodiments have been described above with a certain degree of particularity, those skilled in the art could make numerous alterations to the disclosed embodiments without departing from the scope of this disclosure. All directional references (e.g., plus, minus, upper, lower, upward, downward, left, right, leftward, rightward, top, bottom, above, below, vertical, horizontal, clockwise, and counterclockwise) are only used for identification purposes to aid the reader's understanding of the present disclosure, and do not create limitations, particularly as to the position, orientation, or use of embodiments. Joinder references (e.g., attached, coupled, connected, and the like) are to be construed broadly and may include intermediate members between a connection of elements and relative movement between elements. As such, joinder references do not necessarily imply that two elements are directly connected/coupled and in fixed relation to each other. It is intended that all matter contained in the above description or shown in the accompanying drawings shall be interpreted as illustrative only and not limiting. Changes in detail or structure may be made.

While one or more particular embodiments have been shown and described, it will be understood by those of skill in the art that various changes and modifications can be made without departing from the spirit and scope of the present teachings.

What is claimed is:

1. A modular access system, comprising:

first and second platforms each platform including an upper surface, four side surfaces extending from said upper surface to a lower edge, and four lips extending from said lower edge of said four side surfaces, each of said four side surfaces including first connection apertures, each of said four lips including second connection apertures, wherein said first and second platforms are connected together at a respective selected one of said four side surfaces using elongate fasteners extending through said first connection apertures to define a connection structure, said first and second platforms forming a platform assembly having first and second opposing lateral sides and first and second opposing longitudinal ends;

first and second support angles, said first support angle connected to at least one lip of each of the first and second platforms and forming said first lateral side, said second support angle connected to at least one lip of each of the first and second platforms and forming said second lateral side, said first and second support angles located underneath and spanning across said connection structure and connected to each respective at least one lip of said first and second platforms using elongate fasteners extending through said second connection apertures;

first and second gussets located at said first longitudinal end adjacent to said first and second support angles and each of the first and second gussets mounted to at least one lip of said four lips extending from at least one side surface of said four side surfaces forming said first longitudinal end, said first gusset also being mounted to said at least one lip extending from said at least one side surface forming said first lateral side and said second gusset also being mounted to at least one lip extending from at least one of the four side surfaces forming said second lateral side, said first and second gussets each including third connection apertures;

third and fourth gussets located at said second longitudinal end adjacent to said first and second support angles and each of said third and fourth gussets mounted to respective lips extending from respective side surface forming said second longitudinal end, said third gusset also being mounted to at least one lip of said four lips extending from at least one side surface of said four side surfaces forming said first lateral side and said fourth gusset also being mounted to at least one lip of said four lips extending from at least one side surface of said four side surfaces forming said second lateral side, said third and fourth gussets including fourth connection apertures disposed at said second longitudinal end;

a first stile assembly at said first longitudinal end and having fifth connection apertures, said first stile assembly being connected to at least said first and second gussets using elongate fasteners extending through said third and said fifth connection apertures; and a second stile assembly at said second longitudinal end and having sixth connection apertures, said second stile assembly being connected to said third and fourth gussets using elongate fasteners extending through said fourth and said sixth connection apertures.

2. The modular access system of claim 1 wherein said first stile assembly is further connected to said platform assembly using elongate fasteners extending through said fifth and said first connection apertures, said second stile assembly being further connected to said platform assembly using elongate fasteners extending through said sixth and said first connection apertures.

3. The modular access system of claim 2 wherein said first connection apertures includes three apertures, said fifth connection apertures of said first stile assembly includes four apertures, wherein two of said first connection apertures align with two of said fifth connection apertures.

4. The modular access system of claim 2 wherein said first connection apertures includes three apertures, said sixth connection apertures of said second stile assembly includes four apertures, wherein two of said first connection apertures align with two of said sixth connection apertures.

5. The modular access system of claim 1 wherein at least one gusset from said first, second, third and fourth gussets including seventh connection apertures wherein said first, second, third and fourth of gussets are mounted to at least one lip of said four lips using elongate fasteners extending through aligned said second and seventh connection apertures.

6. The modular access system of claim 5 wherein said at least one gusset further includes a flange having an eighth connection aperture configured for connection to an adjacent support angle, said at least one gusset further including a gusset back including one of (i) said fifth connection apertures and (ii) sixth connection apertures, one of said first and second stile assemblies being connected to said gusset back.

7. The modular access system of claim 1 wherein said first second, third and fourth gussets are respectively connected to adjacent support angles.

8. The modular access system of claim 1 wherein said platform assembly further comprises a third platform, said modular access system further comprises a further pair of support angles mounted underneath a further connection structure.

9. The modular access system of claim 8 wherein said platform assembly further comprises a fourth platform, said system modular access further comprising a still further pair of support angles mounted underneath a still further connection structure.

10. The modular access system of claim 1 further including a guardrail assembly connected to said platform assembly.

11. The modular access system of claim 1 further including a fixed ladder connected to said platform assembly.

12. The modular access system of claim 1 wherein said first and second platforms, said first and second support angles, and said first, second, third and fourth gussets comprise steel material.

13. The modular access system of claim 12 wherein said first and second stile assemblies comprise steel material.

* * * * *